US009255378B2

(12) United States Patent
Sugaya et al.

(10) Patent No.: US 9,255,378 B2
(45) Date of Patent: Feb. 9, 2016

(54) ARM FOR CONSTRUCTION MACHINE

(75) Inventors: Makoto Sugaya, Narita (JP); Takeshi Takahashi, Tsukuba (JP); Takayuki Shimodaira, Ryugasaki (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 137 days.

(21) Appl. No.: 14/003,341

(22) PCT Filed: May 16, 2012

(86) PCT No.: PCT/JP2012/062514

§ 371 (c)(1),
(2), (4) Date: Sep. 5, 2013

(87) PCT Pub. No.: WO2012/157675

PCT Pub. Date: Nov. 22, 2012

(65) Prior Publication Data

US 2014/0010624 A1 Jan. 9, 2014

(30) Foreign Application Priority Data

May 19, 2011 (JP) ..... 2011-112820
May 19, 2011 (JP) ..... 2011-112821
May 19, 2011 (JP) ..... 2011-112825

(51) Int. Cl.
*E02F 3/38* (2006.01)

(52) U.S. Cl.
CPC ..... *E02F 3/38* (2013.01)

(58) Field of Classification Search
CPC ..... G01N 2291/267; G01N 2291/2675; E02F 3/38
See application file for complete search history.

(56) References Cited

U.S. PATENT DOCUMENTS

| | | | | |
|---|---|---|---|---|
| 3,902,295 | A | 9/1975 | Yancey | |
| 2002/0056212 | A1* | 5/2002 | Sasaki et al. | 37/443 |
| 2003/0118433 | A1 | 6/2003 | Janes et al. | |
| 2003/0126772 | A1 | 7/2003 | Masumoto et al. | |
| 2006/0201274 | A1* | 9/2006 | Nakajima et al. | 74/490.01 |
| 2008/0292443 | A1 | 11/2008 | Nose et al. | |
| 2011/0108527 | A1* | 5/2011 | Peters et al. | 219/73.2 |

FOREIGN PATENT DOCUMENTS

| | | | |
|---|---|---|---|
| EP | 1457605 | A1 | 9/2004 |
| EP | 2050881 | A1 | 4/2009 |

(Continued)

OTHER PUBLICATIONS

Extended European Search Report received in corresponding European Application No. 12785926.2 dated Apr. 22, 2015.

*Primary Examiner* — Ernesto Suarez
*Assistant Examiner* — Ronald Jarrett
(74) *Attorney, Agent, or Firm* — Mattingly & Malur, PC

(57) ABSTRACT

An arm of a hydraulic excavator is formed as a box-shaped structural body surrounded by left and right side plates, an upper plate joined to each of the upper end sides of each side plate, a lower plate joined to each of the lower end sides of each side plate, and a thick rear plate joined to each of the rear end sides of each side plate and the upper plate. The side plates are formed by joining a rear thick side plate and a front thin side plate. The upper plate is formed by joining two members, that is, a rear thick upper plate and a front thin upper plate, and the lower plate is formed by joining two members, that is, a rear thick lower plate and a front thin lower plate.

11 Claims, 16 Drawing Sheets

(56) References Cited

FOREIGN PATENT DOCUMENTS

| | | | | | |
|---|---|---|---|---|---|
| JP | 61-027199 | A | | 2/1986 | |
| JP | 2003-34946 | | * | 2/2003 | ..... E02F 3/38 |
| JP | 2003-261956 | A | | 9/2003 | |
| JP | 2005-029984 | A | | 2/2005 | |
| JP | 2005-213819 | | * | 8/2005 | ..... E02F 3/38 |
| JP | 2005-213819 | A | | 8/2005 | |
| JP | 2006-26682 | A | | 2/2006 | |

* cited by examiner

ARM FOR CONSTRUCTION MACHINE

TECHNICAL FIELD

The present invention relates to an arm for construction machine suitably used in a working mechanism mounted on a construction machine such as a hydraulic excavator and the like, for example.

BACKGROUND ART

In general, a hydraulic excavator which is a typical example of a construction machine is composed of an automotive lower traveling structure and an upper revolving structure rotatably mounted on the lower traveling structure. On the front side of a revolving frame constituting the upper revolving structure, a working mechanism performing excavating work of earth and sand and the like is provided capable of moving upward/downward.

Here, the working mechanism of a hydraulic excavator is usually largely constituted by a boom having the base end side rotatably mounted on the revolving frame, an arm rotatably mounted on the distal end side of the boom, a working tool such as a bucket or the like rotatably mounted on the distal end side of the arm, and a boom cylinder, an arm cylinder, and a bucket cylinder driving the boom, the arm, and the bucket, respectively.

The arm constituting such working mechanism is usually formed as a lengthy welded structural body whose entire length is as long as several meters. That is, the arm is formed of left and right side plates, an upper plate joined to the upper end sides of these left and right side plates by welding, a lower plate joined to the lower end side of the left and right side plates by welding, and a rear plate joined to the rear end sides of the left and right side plates and the upper plate by welding. As a result, the arm is formed as a box-shaped structural body having a cross sectional surface of a square closed sectional structure.

On a rear part on the lower side of the arm, a boom connecting boss to be connected to the distal end side of the boom by using a connecting pin is provided, and on the rear end side of the arm, an arm cylinder bracket to which the arm cylinder is connected by using a connecting pin is provided. On the other hand, on the rear part on the upper side of the arm, a bucket cylinder bracket to which the bucket cylinder is connected by using a connecting pin is provided. Moreover, on the front end of the arm, a bucket connecting boss to which the bucket is connected by using a connecting pin is provided (Patent Document 1).

PRIOR ART DOCUMENT

Patent Document

Patent Document 1: Japanese Patent Laid-Open No. 2003-261956 A

SUMMARY OF THE INVENTION

Since the boom connecting boss, the arm cylinder bracket, and the bucket cylinder bracket are provided on the rear side of the arm, strength required for the arm is larger on the rear side than on the front side.

On the other hand, the above-described conventional art arm is usually formed of an upper plate and a lower plate by using a single plate material such as a steel plate material having a uniform plate thickness. Thus, on the front side of the arm, the plate thicknesses of the upper plate and the lower plate are tend to be too large for the required strength, and there is a problem that a weight of the entire arm becomes larger than necessary.

In view of the above-discussed problems with the conventional art, it is an object of the present invention to provide an arm for a construction machine which can reduce the weight of the entirety while ensuring required strength.

(1) In order to solve the above-described problem, the present invention is applied to an arm for a construction machine formed as a box-shaped structural body having a square cross sectional surface having left and right side plates, an upper plate joined to the upper end sides of the left and right side plates by welding, a lower plate joined to the lower end sides of the left and right side plates by welding, and a rear plate joined to the rear end sides of the left and right side plates and the rear end side of the upper plate by welding, comprising: a boom connecting boss located on the rear parts on the lower sides of the left and right side plates and joined to the rear ends of the left and right side plates and the lower plate and the front end of the rear plate by welding; a bucket connecting boss joined to the front ends of the left and right side plates, the upper plate, and the lower plate by welding; and a pair of left and right bucket cylinder brackets joined to an outer surface of the upper plate by welding.

A feature of the present invention is that the upper plate is formed by joining two members, that is, a rear thick upper plate located on the rear side and made of a plate material having a large plate thickness and a front thin upper plate located on the front side of the rear thick upper plate and made of a plate material having a small plate thickness; and each of the bucket cylinder brackets is joined to an outer surface of the rear thick upper plate.

With this arrangement, the rear side requiring large strength in the upper plate constituting the arm can be composed by the rear thick upper plate having a large plate thickness and the front side not requiring large strength compared with the rear side can be formed of the front thin upper plate having a small plate thickness. As a result, the required strength can be ensured by the rear thick upper plate on the rear side of the arm, while weight reduction can be realized by the front thin upper plate on the front side of the arm. As a result, weight reduction of the entire arm can be realized while required strength is kept as compared with a case in which the upper plate is formed by using a single plate material having a uniform plate thickness.

(2) A feature of the present invention is that the lower plate is formed by joining two members, that is, a rear thick lower plate located on the rear side and made of a plate material having a large plate thickness and a front thin lower plate located on the front side of the rear thick lower plate and made of a plate material having a small plate thickness; and the boom connecting boss is configured to be joined to the rear end of the rear thick lower plate.

With this arrangement, the rear side requiring large strength in the lower plate constituting the arm can be constituted by the rear thick lower plate having a large plate thickness and the front side not requiring large strength as compared with the rear side can be constituted by the front thin lower plate having a small plate thickness. As a result, required strength can be ensured by the rear thick lower plate on the rear side of the arm, while weight reduction can be realized by the front thin lower plate on the front side of the arm.

(3) A feature of the present invention is that the upper plate is formed by joining two members, that is, a rear thick upper plate located on the rear side and made of a plate material having a large plate thickness and a front thin upper plate located on the front side of the rear thick upper plate and made of a plate material having a small plate thickness; the lower plate is formed by joining two members, that is, a rear thick lower plate located on the rear side and made of a plate material having a large plate thickness and a front thin lower plate located on the front side of the rear thick lower plate and made of a plate material having a small plate thickness; each of the bucket cylinder brackets is configured to be joined to an outer surface of the rear thick upper plate; and the boom connecting boss is configured to be joined to the rear end of the rear thick lower plate.

With this arrangement, the rear side requiring larger strength in the upper plate and the lower plate constituting the arm can be composed of the rear thick upper plate and the rear thick lower plate having large plate thicknesses and the front side not requiring large strength as compared with the rear side can be composed of the front thin upper plate and the front thin lower plate having small plate thicknesses. As a result, weight reduction of the entire arm can be realized while required strength is ensured on the rear side of the arm.

(4) A feature of the present invention is that the upper plate is formed by joining two members, that is, a rear thick upper plate located on the rear side and made of a plate material having a large plate thickness and a front thin upper plate located on the front side of the rear thick upper plate and made of a plate material having a small plate thickness; the lower plate is formed by joining two members, that is, a rear thick lower plate located on the rear side and made of a plate material having a large plate thickness and a front thin lower plate located on the front side of the rear thick lower plate and made of a plate material having a small plate thickness; the left and right side plates are formed by joining two members, that is, a rear thick side plate located on the rear side and made of a plate material having a large plate thickness and a front thin side plate located on the front side of the rear thick side plate and made of a plate material having a small plate thickness; pair of the bucket cylinder brackets is configured to be joined to an outer surface of the rear thick upper plate; the boom connecting boss is configured to be joined to the rear end of the rear thick lower plate; and a joint portion between the rear thick side plate and the front thin side plate is configured such that an upper end thereof is joined to the rear thick upper plate and a lower end is joined to the rear thick lower plate.

With this arrangement, the left and right side plates, the upper plate, and the lower plate constituting the arm can be configured to be thick on the rear side and to be thin on the front side. As a result, further weight reduction of the entire arm can be realized while required strength is kept on the rear part side of the arm. Moreover, by joining the upper end of the joint portion between rear thick side plate and the front thin side plate to the rear thick upper plate and by joining the lower end of the joint portion between the rear thick side plate and the front thin side plate to the rear thick lower plate, strength of the joint portion between the rear thick side plate and the front thin side plate can be improved, and strength of the entire arm can be improved.

(5) According to the present invention, it is configured such that an internal partition wall for reinforcement is provided between the inner surface side of the rear thick upper plate and the boom connecting boss. With this arrangement, by connecting the boom connecting boss joined to the left and right side plates, the rear end of the lower plate, and the front end of the rear plate and the rear thick upper plate to each other by the internal partition wall, strength of the rear side of the arm on which the boom connecting boss and the bucket cylinder bracket are provided can be improved.

(6) According to the present invention, the rear plate is formed as a thick rear plate using a plate material having a plate thickness equal to or larger than the rear thick upper plate and the rear thick side plates; and the thick rear plate is joined to rear ends of the left and right rear thick side plates and a rear end of the rear thick upper plate and a front end of the thick rear plate is joined to the boom connecting boss. With this arrangement, by joining a front end of the thick rear plate having a plate thickness equal to or larger than the rear thick upper plate and the left and right rear thick side plates to the boom connecting boss, strength of the rear part side of the arm can be further improved.

(7) According to the present invention, a groove extending in the upper-and-lower direction is provided each in a front end of the rear thick side plate and a rear end of the front thin side plate by cutting away without a root face; a V-shaped groove without a root face or a gap is formed by having the groove of the rear thick side plate and the groove of the front thin side plate abut each other; and a welding bead is formed by applying welding between the rear thick side plate and the front thin side plate at the position of the V-shaped groove.

With this arrangement, by performing butt welding at the position of the V-shaped groove where the front end of the rear thick side plate and the rear end of the front thin side plate abut each other, perfect welding in which the rear thick side plate and the front thin side plate are blended over the entire region of the plate thickness can be obtained. As a result, joint strength between the rear thick side plate and the front thin side plate can be improved, and strength and durability of the entire arm can be improved.

Moreover, by forming the V-shaped groove without a root face or a gap at the abutted portion between the rear thick side plate and the front thin side plate, perfect welding can be performed on the abutted portion between the rear thick side plate and the front thin side plate without arranging a backing material on the back side of the V-shaped groove. Therefore, workability when butt welding is performed between the rear thick side plate and the front thin side plate can be improved.

(8) According to the present invention, in the bucket connecting boss, each of flange portions located on the both left and right sides of a cylindrical boss portion and extending toward the left and right side plates is provided; a groove extending in the upper-and-lower direction is provided on the front ends of the left and right side plates, respectively by cutting away without a root face; a groove extending in the upper-and-lower direction is provided on the rear ends of the left and right flange portions of the bucket connecting boss, respectively by cutting away without a root face; and each of V-shaped grooves without a root face or a gap, respectively, is formed by abutting the grooves of the left and right side plates and the grooves of the left and right flange portions, and each of welding beads is formed by applying welding between the left and right side plates and the left and right flange portions at the position of the V-shaped grooves.

(9) According to the present invention, a groove extending in the left-and-right direction is provided on the front end of the rear thick upper plate and the rear end of the front thin upper plate, respectively by cutting away without a root face; a V-shaped groove without a root face or a gap is formed by abutting the groove of the rear thick upper plate and the groove of the front thin upper plate; and a welding bead is formed by applying welding between the rear thick upper plate and the front thin upper plate at the position of the V-shaped groove.

(10) According to the present invention, a groove extending in the left-and-right direction is provided on the front end of the rear thick lower plate and the rear end of the front thin lower plate, respectively by cutting away without a root face; a V-shaped groove without a root face or a gap is formed by abutting the groove of the rear thick lower plate and the groove of the front thin lower plate; and a welding bead is formed by applying welding between the rear thick lower plate and the front thin lower plate at the position of the V-shaped groove.

(11) According to the present invention, a groove angle of the V-shaped groove is configured to be set within a range of 43 degrees or more and 90 degrees or less. According to this configuration, when the two members are subjected to butt welding using means such as arc welding or the like, heat of the arc can be sufficiently supplied to the groove of one member and the groove of the other member abutted to each other, and the two members can be blended over the entire region of the plate thickness. Moreover, by setting the groove angle of the V-shaped groove at the abutted portion of the two members at 90 degrees or less, the inside of this V-shaped groove can be filled with molten metal without excess or shortage, and a welding bead continuing smoothly between the two members can be formed.

(12) According to the present invention, an auxiliary welding member having a flat plate shape is provided on an outer surface of the rear part side of the upper plate so as to surround a welded portion between the pair of left and right bucket cylinder brackets and the upper plate; and a welding bead is formed by applying fillet welding around the auxiliary welding member.

With this arrangement, by providing the auxiliary welding member, a plate thickness of a portion in the upper plate where each bucket cylinder bracket is joined can be made partially thick. As a result, large deformation of an upper plate or each bucket cylinder bracket caused by load acting on each bucket cylinder bracket can be suppressed, and durability of the entire arm can be improved. Moreover, by applying fillet welding to the periphery of the auxiliary welding member, a welded portion between each bucket cylinder bracket and the upper plate can be reinforced by a welding bead formed between the auxiliary welding member and the upper plate. Thus, stress generated in a welded portion between each bucket cylinder bracket and the upper plate can be reduced. As a result, strength of the upper plate and each bucket cylinder bracket can be improved without increasing the plate thickness of the upper plate or each bucket cylinder bracket, and weight reduction of the entire arm can be realized while required strength is ensured.

(13) According to the present invention, an internal partition wall for reinforcement is provided between the boom connecting boss and a position on the inner surface side of the upper plate and on the front side of a position of a connecting pin provided on each of the bucket cylinder brackets; and the rear end of the auxiliary welding member is configured to be extended to the rear side of the upper end position of the internal partition wall. As a result, deformation of the upper plate as if sinking to the inner surface side by receiving load can be suppressed by the internal partition wall.

(14) According to the present invention, a gap generated between each of the bucket cylinder brackets and the auxiliary welding member on the outer surface of the upper plate is configured to be embedded by a welding bead of each of the bucket cylinder brackets and a welding bead of the auxiliary welding member. As a result, the welding bead formed between the bucket cylinder bracket and the upper plate and the welding bead formed between the auxiliary welding member and the upper plate can be integrated. As a result, joint strength of the bucket cylinder bracket to the upper plate can be improved.

(15) According to the present invention, the auxiliary welding member is formed having the M-shape on a plan view; and a notched portion notched having a rearward recessed shape is provided on the front part side of the M-shaped auxiliary welding member. With this arrangement, by applying fillet welding to the periphery of the auxiliary welding member, weld length can be ensured large. As a result, joint strength of the auxiliary welding member to the upper plate can be improved, and strength of the welded portion between the upper plate reinforced by this auxiliary welding member and the bucket cylinder bracket can be further improved.

MODE FOR CARRYING OUT THE INVENTION

Figure 1:
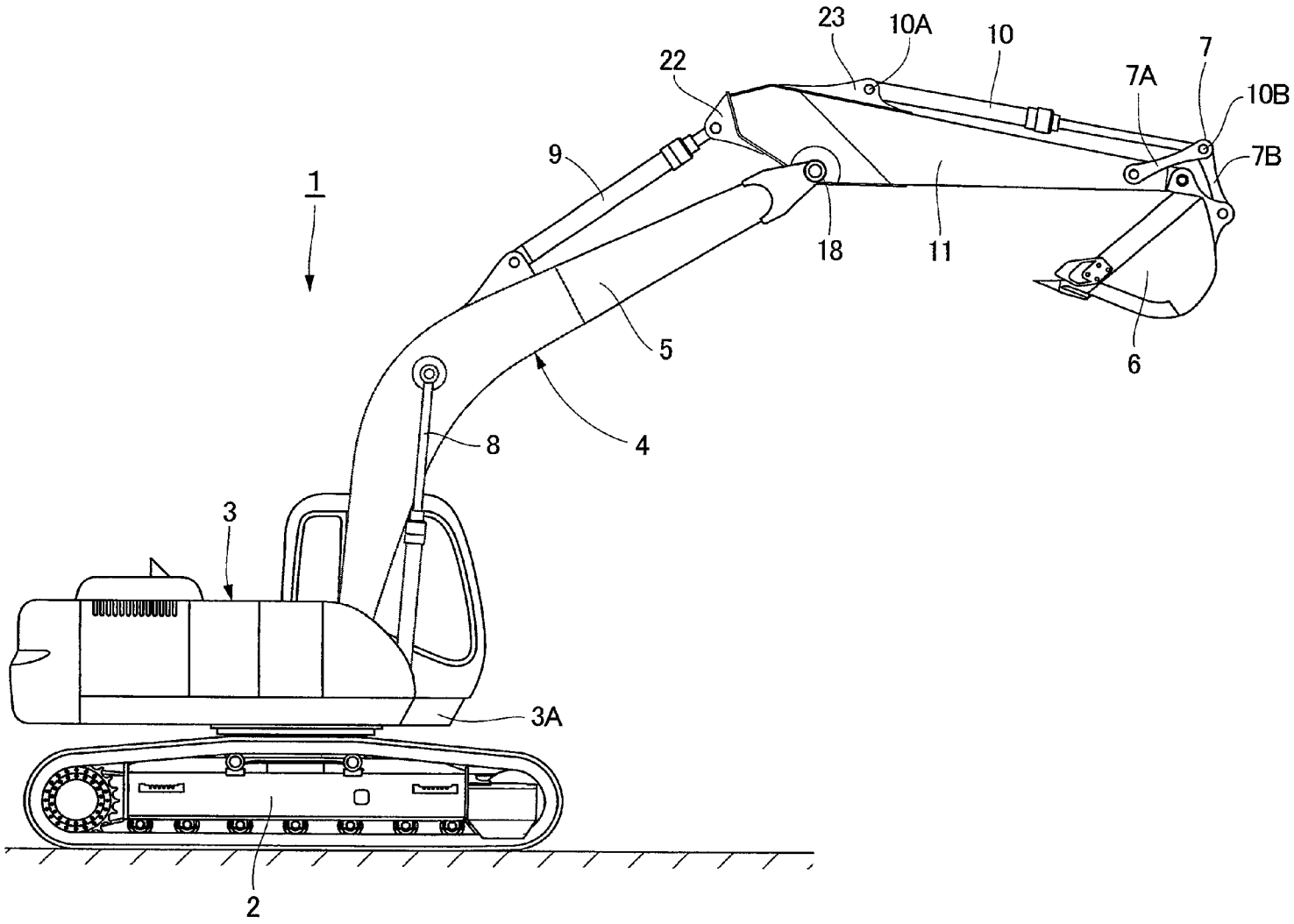
FIG. 1 is a front view illustrating a hydraulic excavator as a construction machine provided with an arm according to the present invention.

An embodiment of an arm for a construction machine according to the present invention will be described below in detail with reference to the accompanying drawings by taking a case in which the construction machine is applied to an arm of a hydraulic excavator as an example.

Designated at 1 is a hydraulic excavator as a typical example of a construction in the figure. The hydraulic excavator 1 is provided with an automotive crawler-type lower traveling structure 2 and an upper revolving structure 3 rotatably mounted on the lower traveling structure 2. A working mechanism 4 is provided capable of upward/downward movement on the front part side of a revolving frame 3A which becomes a base of the upper revolving structure 3.

The working mechanism 4 is provided with a boom 5 having a base end portion pin-connected to the front side of the revolving frame 3A capable of upward/downward movement, an arm 11 which will be described later and has a base end portion rotatably pin-connected to a distal end portion of the boom 5, a bucket 6 rotatably pin-connected to a distal end portion of the arm 11, and a bucket link 7 provided between the distal end side of the arm 11 and the bucket 6. Moreover, the working mechanism 4 is provided with a boom cylinder 8 for moving upward/downward the boom 5 with respect to the revolving frame 3A, an arm cylinder 9 for rotating the arm 11 with respect to the boom 5, and a bucket cylinder 10 for rotating the bucket 6 with respect to the arm 11.

Here, the bucket link 7 is composed of a rear link 7A having one end side connected to the distal end side of the arm 11 and a front link 7B having one end side connected to the other end side of the rear link 7A and the other end side connected to the bucket 6. On the other hand, the bottom side of the bucket cylinder 10 is mounted to a bucket cylinder bracket 23 of the arm 11 which will be described later by using a connecting pin 10A. The rod side of the bucket cylinder 10 is connected to a connection portion between the rear link 7A and the front link 7B of the bucket link 7 by using a connecting pin 10B.

Next, the arm according to this embodiment will be described by referring to FIGS. 2 to 8.

Designated at 11 is the arm rotatably mounted on the distal end portion of the boom 5. This arm 11 is formed as a lengthy box-shaped structural body extending in the fore-and-rear direction as a whole and is rotated in the upper-and-lower direction by the arm cylinder 9 with respect to the boom 5.

Here, the arm 11 is formed of left and right side plates 12 and 13, an upper plate 14, a lower plate 15, and a thick rear plate 16 which will be described later, and the arm 11 has a box-shaped structural body having a cross sectional surface with a square closed sectional structure as a whole. On the rear side (boom 5 side) of the arm 11, a boom connecting boss 18, an arm cylinder bracket 22, the bucket cylinder bracket 23 and the like which will be described later are provided. On the other hand, on the front side (bucket 6 side) of the arm 11, a bucket connecting boss 20, a rear link connecting boss 21 and the like which will be described later are provided.

Figure 4:
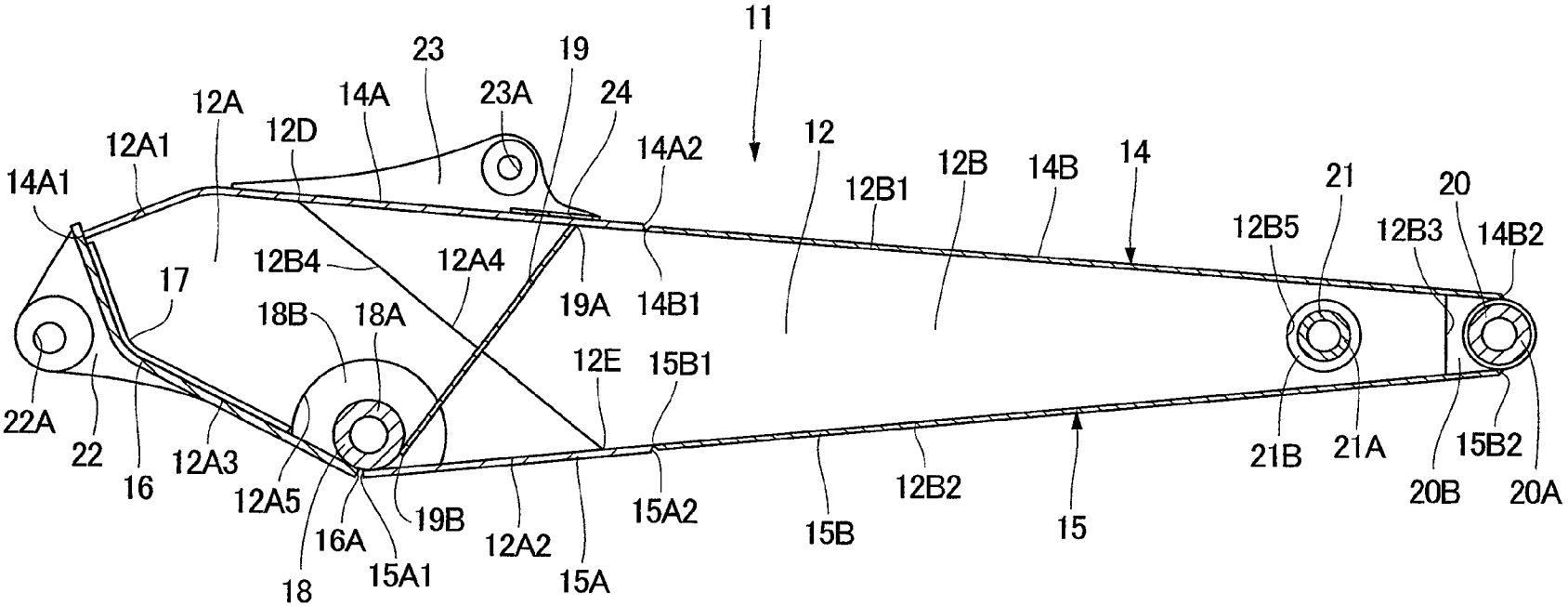
FIG. 4 is a sectional view of the arm seen from an arrow IV-IV direction in FIG. 3.
Figure 8:
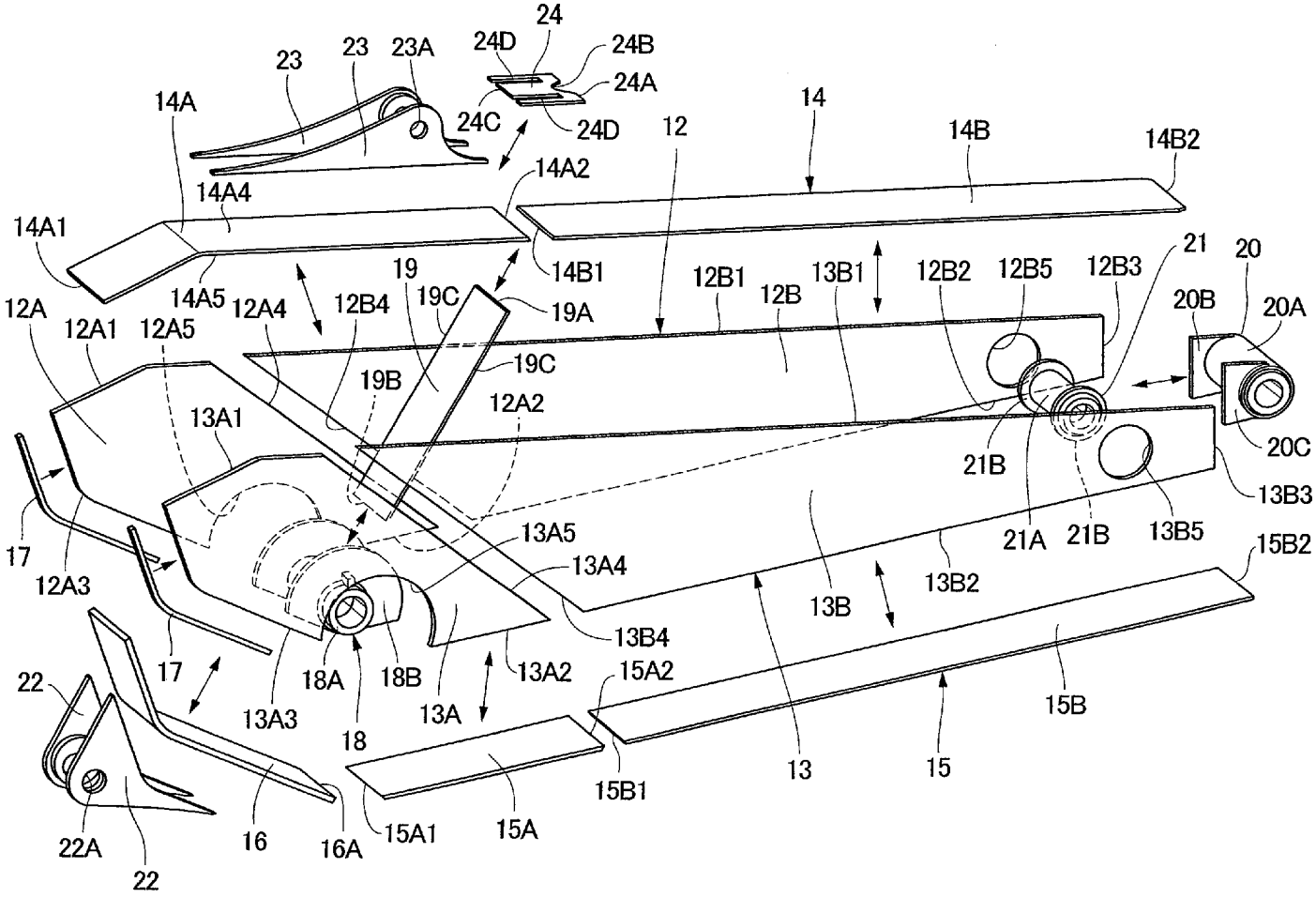
FIG. 8 is an exploded perspective view illustrating a side plate, an upper plate, a lower plate, a rear plate, a boom connecting boss, an arm cylinder bracket, and a bucket cylinder bracket constituting the arm in an exploded state.

Designated at 12 is a left side plate constituting a left side surface of the arm 11. The left side plate 12 extends in the fore-and-rear direction while facing a right side plate 13 which will be described later in the left-and-right direction. Here, as illustrated in FIGS. 4 and 8, the left side plate 12 is formed by joining two members, that is, a rear thick side plate 12A located on the rear side in the fore-and-rear direction and a front thin side plate 12B located on the front side in the fore-and-rear direction. The boom connecting boss 18 which will be described later is fixed to the rear thick side plate 12A, and the bucket connecting boss 20, the rear link connecting boss 21 which will be described later are fixed to the front thin side plate 12B.

The rear thick side plate 12A is formed by using a plate material such as a steel plate having a large plate thickness and has a hexagonal shape surrounded by an upper plate joining part 12A1, a lower plate joining part 12A2, a rear plate joining part 12A3, and a front thin side plate joining part 12A4. In this case, the front thin side plate joining part 12A4 is configured to ensure a large length of a joint portion between the rear thick side plate 12A and the front thin side plate 12B by extending diagonally forward from the upper plate joining part 12A1 to the lower plate joining part 12A2. A corner portion where the lower plate joining part 12A2 and the rear plate joining part 12A3 intersect each other, a boom connecting boss joining groove 12A5 cut out in an arc shape is provided for joining a flange portion 18B of the boom connecting boss 18.

On the front end of the rear thick side plate 12A, a groove 12A6 is provided, and the groove 12A6 is abutted to a rear side groove 12B6 of the front thin side plate 12B which will be described later. Here, as illustrated in FIGS. 9 to 12, the groove 12A6 is formed by cutting out an end edge of the front thin side plate joining part 12A4 constituting the rear thick side plate 12A with inclination toward the outer surface side. This groove 12A6 is formed as a uniform inclined surface without a root face and is provided over the entire region of the front thin side plate joining part 12A4.

On the other hand, the front thin side plate 12B is formed by using a plate material such as a steel plate having a plate thickness smaller than that of the rear thick side plate 12A and has a square shape surrounded by an upper plate joining part 12B1, a lower plate joining part 12B2, a bucket connecting boss joining part 12B3, and a rear thick side plate joining part 12B4. In this case, the rear thick side plate joining part 12B4 extends diagonally forward from the upper plate joining part 12B1 to the lower plate joining part 12B2. On the front end side of the front thin side plate 12B, a rear link connecting boss joining hole 12B5 made of a circular hole for joining a flange portion 21B of the rear link connecting boss 21 is provided.

On the rear end of the front thin side plate 12B, the rear side groove 12B6 is provided, and the rear side groove 12B6 is abutted to the groove 12A6 of the rear thick side plate 12A. Here, as illustrated in FIGS. 9 to 12, the rear end groove 12B6 is formed by cutting out an end edge of the rear thick side plate joining part 12B4 constituting the front thin side plate 12B with inclination toward the outer surface side. This groove 12B6 is formed as a uniform inclined surface without a root face and is provided over the entire region of the rear thick side plate joining part 12B4.

On the front end of the front thin side plate 12B, a front side groove 12B7 is provided, and the front side groove 12B7 is abutted to a groove 20B1 provided on a left flange portion 20B of the bucket connecting boss 20 which will be described later. Here, as illustrated in FIGS. 13 to 16, the front side groove 12B7 is formed as a uniform inclined surface without a root face by cutting out an end edge portion of the bucket connecting boss joining part 12B3 constituting the front thin side plate 12B with inclination toward the inner surface side.

Figure 6:
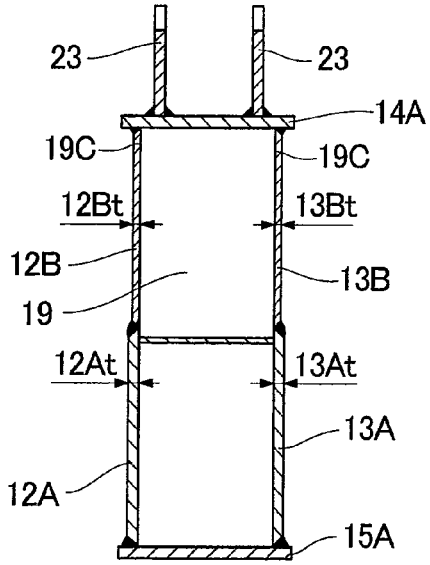
FIG. 6 is a sectional view of left and right side plates, the rear thick upper plate, and the rear thick lower plate seen from an arrow VI-VI direction in FIG. 5.
Figure 7:
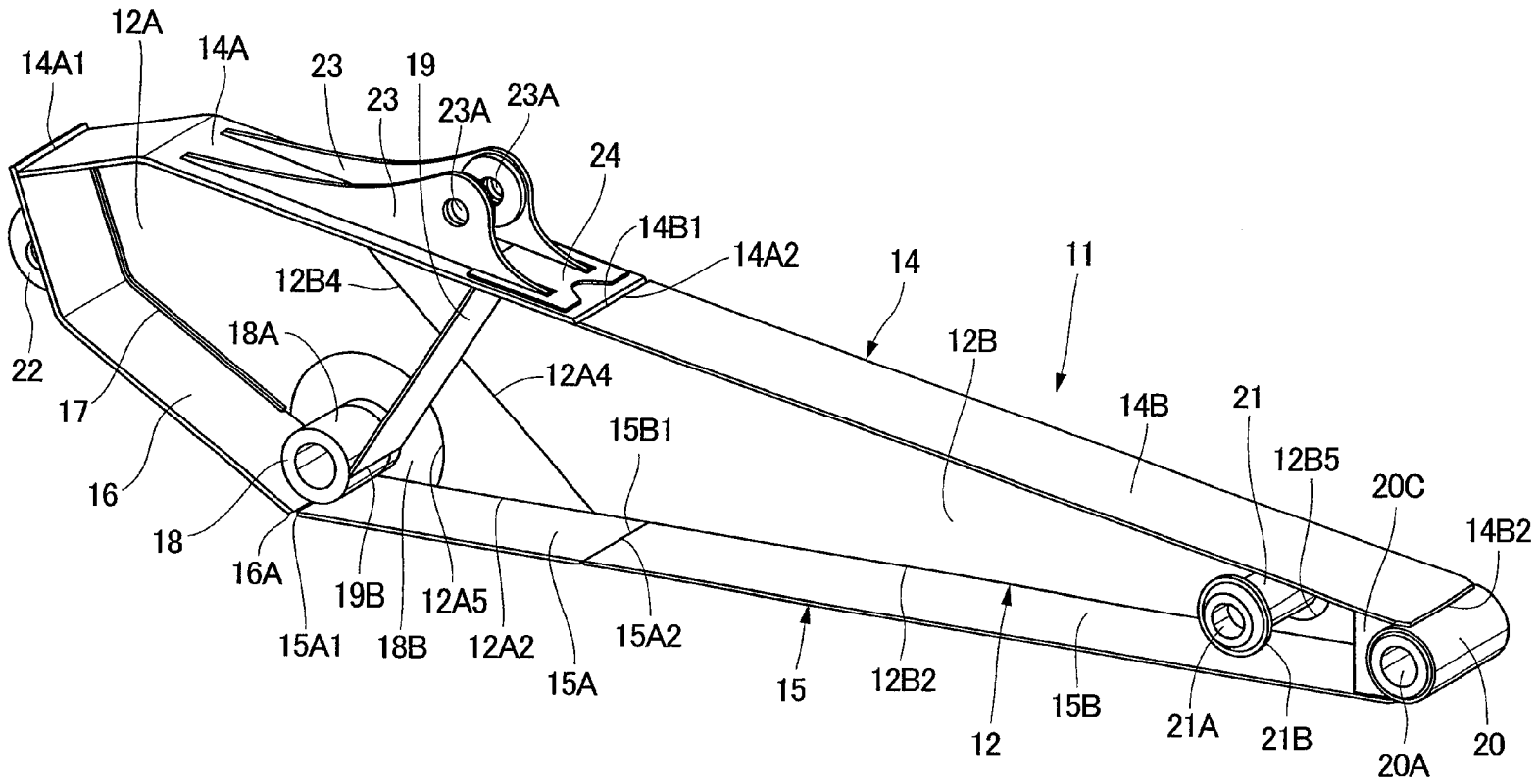
FIG. 7 is a perspective view illustrating an inside of the arm in a state where the right side plate is removed.
Figure 9:
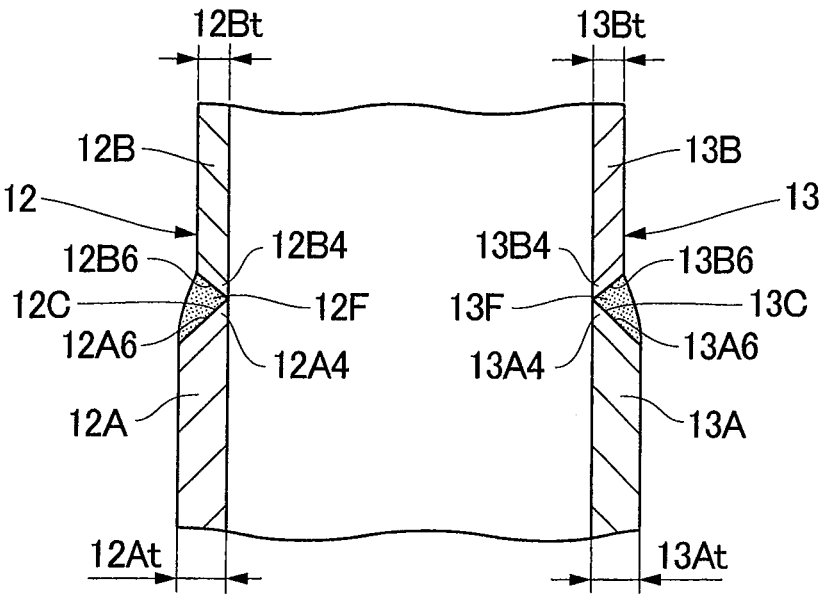
FIG. 9 is a sectional view of a joint portion between the rear thick side plate and the front thin side plate seen from an arrow IX-IX direction in FIG. 5.

On the other hand, as illustrated in FIGS. 6 and 9, assuming that a plate thickness of the rear thick side plate 12A constituting the left side plate 12 is 12At and a plate thickness of the front thin side plate 12B is 12Bt, a relationship between the plate thickness 12At and the plate thickness 12Bt is set as in the following formula 1:

$$12At > 12Bt \quad \text{[Formula 1]}$$

Figure 11:
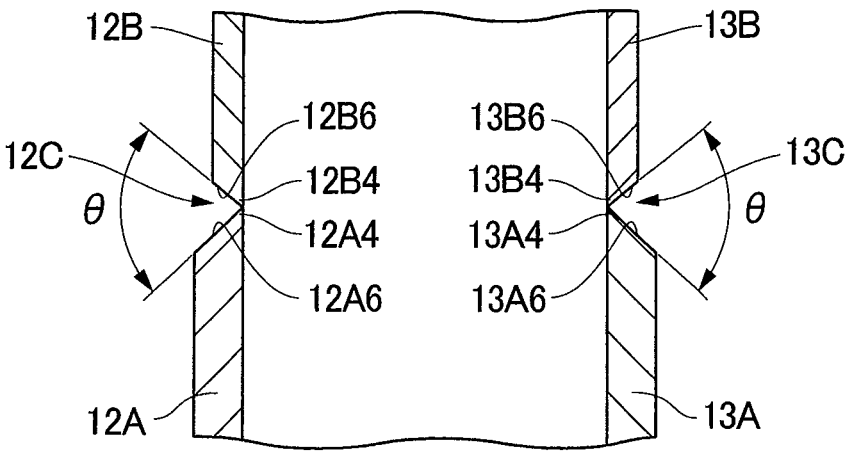
FIG. 11 is a sectional view illustrating a V-shaped groove formed by the groove of the rear thick side plate and the groove of the front thin side plate.

Here, as illustrated in FIG. 11, by abutting the groove 12A6 of the rear thick side plate 12A and the rear side groove 12B6 of the front thin side plate 12B to each other without a gap, an inner surface of the rear thick side plate 12A and an inner surface of the front thin side plate 12B form the same plane without a step. On the other hand, an outer surface of the rear thick side plate 12A and an outer surface of the front thin side plate 12B form a step according to a difference in plate thickness, and in this stepped portion, a V-shaped groove 12C without a root face or a gap is formed. In this case, by setting a groove angle of the V-shaped groove 12C to θ, this groove angle θ is set within a range of the following formula 2:

$$43° \leq \theta \leq 90° \quad \text{[Formula 2]}$$

Figure 12:
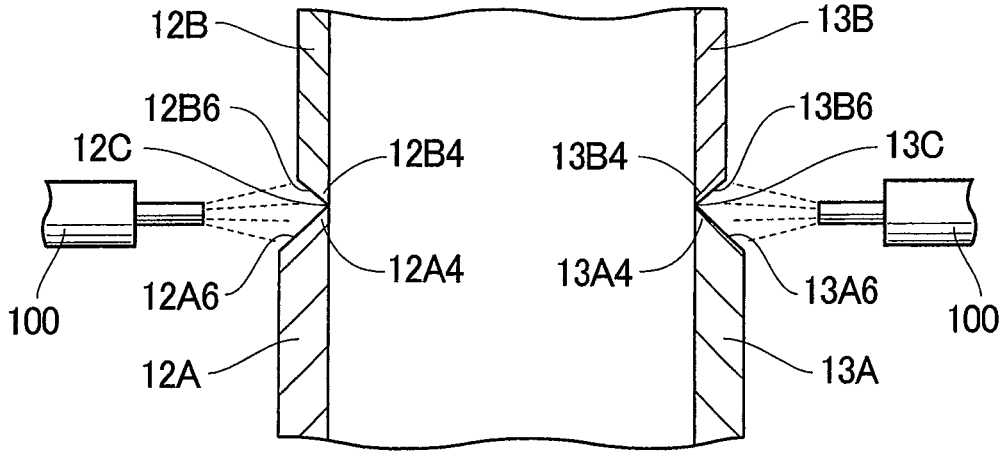
FIG. 12 is a sectional view illustrating a state where the rear thick side plate and the front thin side plate are abutted to each other and welded at the position of the V-shaped groove.
Figure 13:
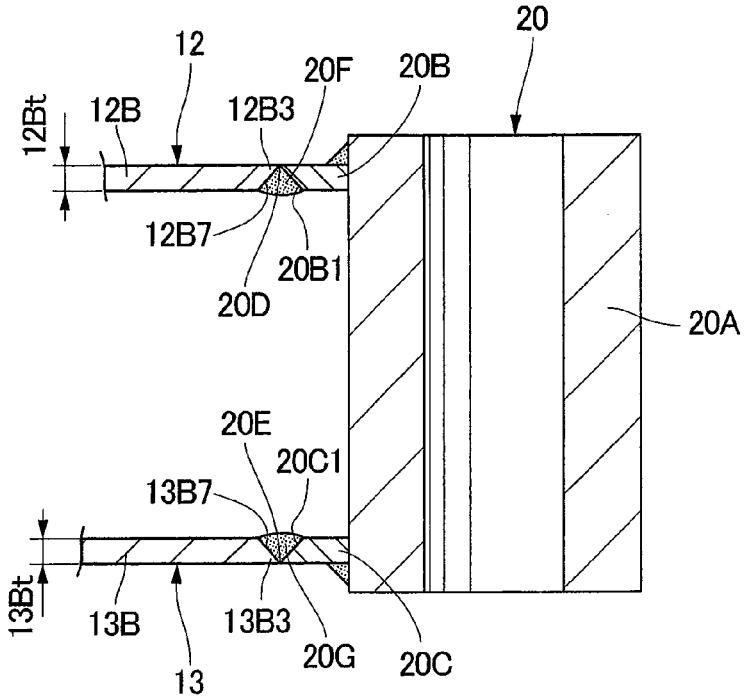
FIG. 13 is a sectional view of a joint portion between the front thin side plate and the bucket connecting boss seen from an arrow XIII-XIII direction in FIG. 2.

Then, as illustrated in FIG. 12, by performing butt welding at the position of the V-shaped groove 12C by using a welding torch 100 and the like, the front thin side plate joining part 12A4 of the rear thick side plate 12A and the rear thick side plate joining part 12B4 of the front thin side plate 12B are joined in a perfect welding state, and the left side plate 12 made of the rear thick side plate 12A and the front thin side plate 12B is formed.

Here, an opening width of the V-shaped groove 12C is determined in accordance with an outer diameter dimension of the welding torch 100. Moreover, the groove angle θ of the V-shaped groove 12C is determined on the basis of the outer diameter dimension of the welding torch 100, the plate thickness 12At of the rear thick side plate 12A and the plate thickness 12Bt of the front thin side plate 12B, and an amount of required welding bead. In this case, if the groove angle θ is too small, the rear thick side plate 12A and the front thin side plate 12B do not sufficiently blend, while if the groove angle θ is too large, the amount of bead to be used increases and welding workability lowers, and thus, the groove angle θ is preferably set within a range of the above-described formula 2. It should be noted that the groove angles θ of the V-shaped grooves 13C, 14C, 15C, 20D, and 20E which will be described later are also set within the range of the above-described formula 2 similarly to the groove angle θ of the V-shaped groove 12C.

Designated at 13 is a right side plate constituting a right side surface of the arm 11, and the right side plate 13 has the same shape as that of the left side plate 12. Namely, the right side plate 13 is formed by joining two members, that is, a rear thick side plate 13A located on the rear side in the fore-and-rear direction and a front thin side plate 13B located on the front side in the fore-and-rear direction. To the rear thick side plate 13A, the boom connecting boss 18 which will be described later is fixed, while to the front thin side plate 13B, the bucket connecting boss 20 and the rear link connecting boss 21, which will be described later are fixed.

The rear thick side plate 13A is formed by using a plate material such as a steel plate having a large plate thickness and has a hexagonal shape surrounded by an upper plate joining part 13A1, a lower plate joining part 13A2, a rear plate joining part 13A3, and a front thin side plate joining part 13A4. At a corner portion where the lower plate joining part 13A2 and the rear plate joining part 13A3 intersect each other, a boom connecting boss joining groove 13A5 cut out in an arc shape is provided.

On the front end of the rear thick side plate 13A, a groove 13A6 is provided, and the groove 13A6 is abutted to a rear side groove 13B6 of the front thin side plate 13B which will be described later. Here, as illustrated in FIGS. 9 to 12, the groove 13A6 is formed as a uniform inclined surface without a root face by cutting out an end edge of the front thin side plate joining part 13A4 constituting the rear thick side plate 13A with inclination toward the outer surface side.

On the other hand, the front thin side plate 13B is formed by using a plate material such as a steel plate having a plate thickness smaller than that of the rear thick side plate 13A and has a square shape surrounded by an upper plate joining part 13B1, a lower plate joining part 13B2, a bucket connecting boss joining part 13B3, and a rear thick side plate joining part 13B4. On the front end side of the front thin side plate 13B, a rear link connecting boss joining hole 13B5 made of a circular hole is provided.

On the rear end of the front thin side plate 13B, the rear side groove 13B6 is provided, and the rear side groove 13B6 is abutted to the groove 13A6 of the rear thick side plate 13A. Here, as illustrated in FIGS. 9 to 12, the rear side groove 13B6 is formed as a uniform inclined surface without a root face by cutting out an end edge of the rear thick side plate joining part 13134 constituting the front thin side plate 13B with inclination toward the outer surface side.

On the front end of the front thin side plate 13B, a front side groove 13B7 is provided, and the front side groove 13B7 is abutted to a groove 20C1 provided on a right flange portion 20C of the bucket connecting boss 20 which will be described later. Here, as illustrated in FIGS. 13 to 16, the front side groove 13B7 is formed as a uniform inclined surface without a root face by cutting out an end edge of the bucket connecting boss joining part 13B3 constituting the front thin side plate 13B with inclination toward the inner surface side.

On the other hand, as illustrated in FIGS. 6 and 9, assuming that a plate thickness of the rear thick side plate 13A constituting the right side plate 13 is 13At and a plate thickness of the front thin side plate 13B is 13Bt, a relationship between the plate thickness 13At and the plate thickness 13Bt is set as in the following formula 3:

$$13At>13Bt \quad \text{[Formula 3]}$$

As illustrated in FIG. 11, by abutting the groove 13A6 of the rear thick side plate 13A and the rear side groove 13B6 of the front thin side plate 13B to each other without a gap, an inner surface of the rear thick side plate 13A and an inner surface of the front thin side plate 13B form the same plane without a step. On the other hand, an outer surface of the rear thick side plate 13A and an outer surface of the front thin side plate 13B form a step according to a difference in plate thickness, and in this stepped portion, a V-shaped groove 13C having a groove angle θ without a root face or a gap is formed.

As illustrated in FIG. 12, butt welding is performed at the position of the V-shaped groove 13C by using the welding torch 100 and the like. As a result, the front thin side plate joining part 13A4 of the rear thick side plate 13A and the rear thick side plate joining part 13B4 of the front thin side plate 13B are joined in a perfect welding state, and the right side plate 13 made of the rear thick side plate 13A and the front thin side plate 13B is formed.

Subsequently, designated at 14 is an upper plate constituting an upper surface of the arm 11. This upper plate 14 is joined to the upper end sides of the left and right side plates 12 and 13 and extends in the fore-and-rear direction. Here, the upper plate 14 is formed by joining two members, that is, a rear thick upper plate 14A located on the rear side of the fore-and-rear direction and a front thin upper plate 14B located on the front side of the fore-and-rear direction. To the rear thick upper plate 14A, the bucket cylinder bracket 23 which will be described later is fixed.

The rear thick upper plate 14A is formed having a rectangular plate shape extending in the fore-and-rear direction by using a plate material such as a steel plate having a large plate thickness and the like, and a portion on the rear side of the bucket cylinder bracket 23 is slightly bent diagonally downward. A rear end edge of the rear thick upper plate 14A becomes a rear plate joining part 14A1 to be joined to the thick rear plate 16 which will be described later, and a front end edge of the rear thick upper plate 14A becomes a front thin upper plate joining part 14A2 to be joined to the front thin upper plate 14B. Moreover, to an outer surface 14A4 of the rear thick upper plate 14A, the bucket cylinder bracket 23 which will be described later is joined, and to an inner surface 14A5 of the rear thick upper plate 14A, an upper end 19A of an internal partition wall 19 which will be described later is joined.

On the front end of the rear thick upper plate 14A, a groove 14A3 is provided, and the groove 14A3 is abutted to a groove 14B3 of the front thin upper plate 14B which will be described later. Here, as illustrated in FIGS. 17 to 20, the groove 14A3 is formed as a uniform inclined surface without a root face by cutting out an end edge of the front thin upper plate joining part 14A2 constituting the rear thick upper plate 14A with inclination toward the outer surface 14A4 side.

On the other hand, the front thin upper plate 14B is formed having a rectangular plate shape extending in the fore-and-rear direction by using a plate material such as a steel plate having a plate thickness smaller than that of the rear thick upper plate 14A. A rear end edge of the front thin upper plate 14B becomes a rear thick upper plate joining part 14B1 and a front end edge of the front thin upper plate 14B becomes a bucket connecting boss joining part 14B2 to be joined to the bucket connecting boss 20 which will be described later.

On the rear end of the front thin upper plate 14B, a groove 14B3 is provided, and the groove 14B3 is abutted to the groove 14A3 of the rear thick upper plate 14A. Here, as illustrated in FIGS. 17 to 20, the groove 14B3 is formed as a uniform inclined surface without a root face by cutting out an end edge of the rear thick upper plate joining part 14B1 constituting the front thin upper plate 14B with inclination toward the outer surface side.

Figure 5:
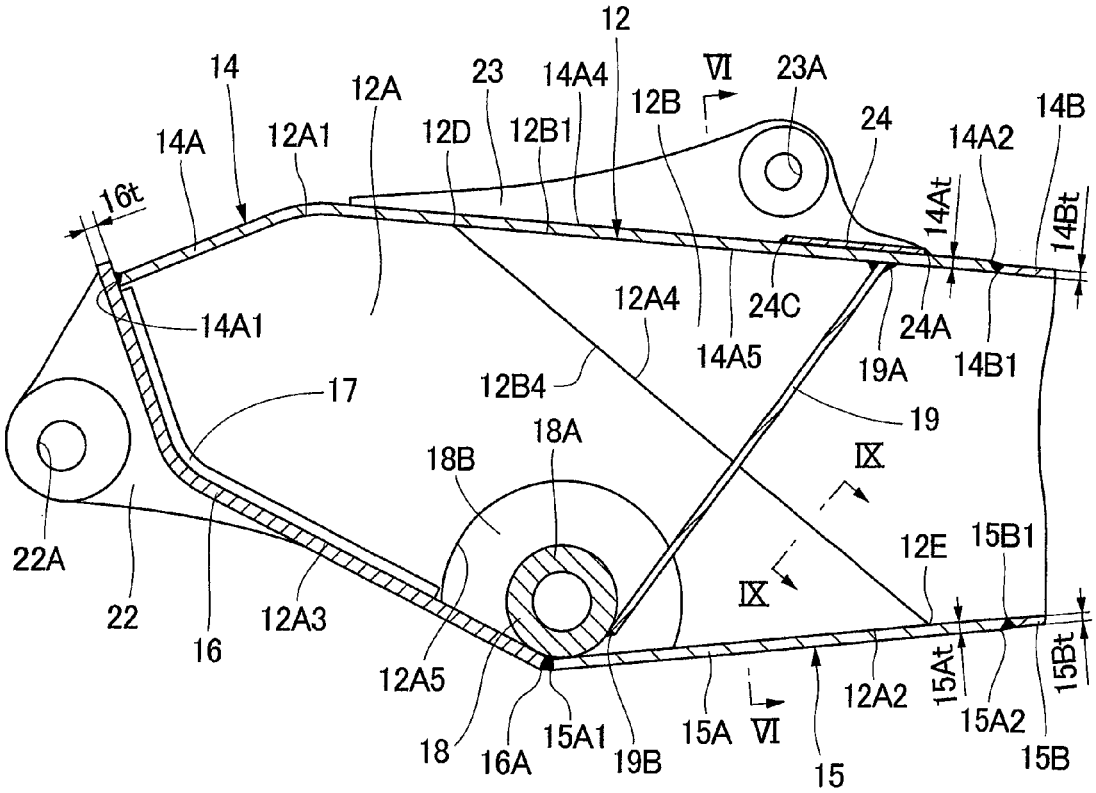
FIG. 5 is an enlarged sectional view illustrating a rear thick upper plate, a front thin upper plate, a rear thick lower plate, a front thin lower plate, and a thick rear plate in FIG. 4.
Figure 17:
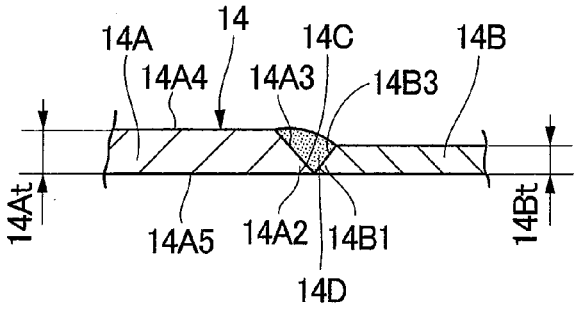
FIG. 17 is a sectional view illustrating a joint portion between the rear thick upper plate and the front thin upper plate.

On the other hand, as illustrated in FIGS. 5 and 17, assuming that a plate thickness of the rear thick upper plate 14A constituting the upper plate 14 is 14At and a plate thickness of the front thin upper plate 14B is 14Bt, a relationship between the plate thickness 14At and the plate thickness 14Bt is set as in the following formula 4:

$$14At>14Bt \quad \text{[Formula 4]}$$

Figure 19:
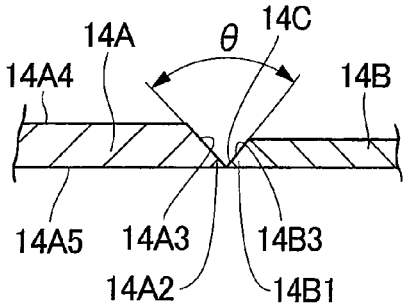
FIG. 19 is a sectional view illustrating a V-shaped groove formed by the groove of the rear thick upper plate and the groove of the front thin upper plate.

As illustrated in FIG. 19, by abutting the groove 14A3 of the rear thick upper plate 14A and the groove 14B3 of the front thin upper plate 14B to each other without a gap, the inner surface 14A5 of the rear thick upper plate 14A and an inner surface of the front thin upper plate 14B form the same plane without a step. On the other hand, the outer surface 14A4 of the rear thick upper plate 14A and an outer surface of the front thin upper plate 14B form a step according to a difference in plate thickness, and in this stepped portion, a V-shaped groove 14C having a groove angle θ without a root face or a gap is formed.

Figure 20:
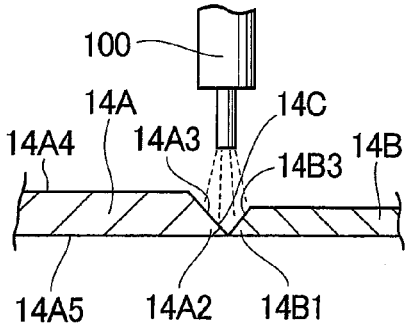
FIG. 20 is a sectional view illustrating a state of butt welding of the rear thick upper plate and the front thin upper plate at the position of the V-shaped groove.

As illustrated in FIG. 20, butt welding is performed at the position of the V-shaped groove 14C by using the welding torch 100 and the like. As a result, the front thin upper plate joining part 14A2 of the rear thick upper plate 14A and the rear thick upper plate joining part 14B1 of the front thin upper plate 14B are joined in a perfect welding state, and the upper plate 14 made of the rear thick upper plate 14A and the front thin upper plate 14B is formed.

Subsequently, designated at 15 is a lower plate constituting a lower surface of the arm 11. This lower plate 15 is joined to the lower end sides of the left and right side plates 12 and 13 and extends in the fore-and-rear direction. Here, the lower plate 15 is formed by joining two members, that is, a rear thick lower plate 15A located on the rear side of the fore-and-rear direction and a front thin lower plate 15B located on the front side of the fore-and-rear direction.

The rear thick lower plate 15A is formed having a rectangular plate shape extending in the fore-and-rear direction by using a plate material such as a steel plate having a large plate thickness and the like. A rear end edge of the rear thick lower plate 15A becomes a boom connecting boss joining part 15A1 to be joined to the boom connecting boss 18 which will be described later. A front end edge of the rear thick lower plate 15A becomes a front thin lower plate joining part 15A2 to be joined to the front thin lower plate 15B.

On the front end of the rear thick lower plate 15A, a groove 15A3 is provided, and the groove 15A3 is abutted to a groove 15B3 of the front thin lower plate 15B which will be described later. Here, as illustrated in FIGS. 21 to 24, the groove 15A3 is formed as a uniform inclined surface without a root face by cutting out an end edge of the front thin lower plate joining part 15A2 constituting the rear thick lower plate 15A with inclination toward the outer surface side.

On the other hand, the front thin lower plate 15B is formed having a rectangular plate shape extending in the fore-and-rear direction by using a plate material such as a steel plate having a plate thickness smaller than that of the rear thick lower plate 15A. A rear end edge of the front thin lower plate 15B becomes a rear thick lower plate joining part 15B1. A front end edge of the front thin lower plate 15B becomes a bucket connecting boss joining part 15B2 to be joined to the bucket connecting boss 20 which will be described later.

On the rear end of the front thin lower plate 15B, a groove 15B3 is provided, and the groove 15B3 is abutted to the groove 15A3 of the rear thick lower plate 15A. Here, as illustrated in FIGS. 21 to 24, the groove 15B3 is formed as a uniform inclined surface without a root face by cutting out an end edge of the rear thick lower plate joining part 15B1 constituting the front thin lower plate 15B with inclination toward the outer surface side.

Figure 21:
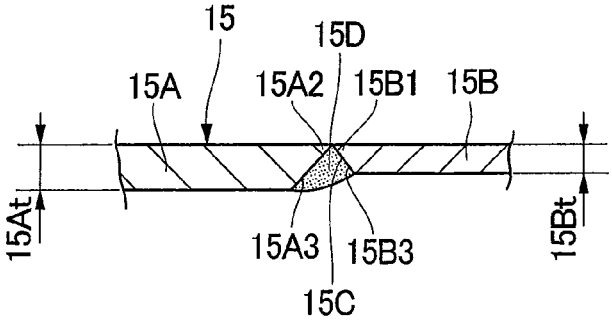
FIG. 21 is a sectional view illustrating a joint portion between the rear thick lower plate and the front thin lower plate.

On the other hand, as illustrated in FIGS. 5 and 21, assuming that a plate thickness of the rear thick lower plate 15A constituting the lower plate 15 is 15At and a plate thickness of the front thin lower plate 15B is 15Bt, a relationship between the plate thickness 15At and the plate thickness 15Bt is set as in the following formula 5:

$$15At > 15Bt \quad \text{[Formula 5]}$$

Figure 23:
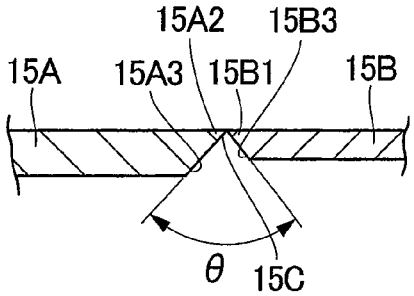
FIG. 23 is a sectional view illustrating a V-shaped groove formed by the groove of the rear thick lower plate and the groove of the front thin lower plate.

As illustrated in FIG. 23, by abutting the groove 15A3 of the rear thick lower plate 15A and the groove 15B3 of the front thin lower plate 15B to each other without a gap, an inner surface of the rear thick lower plate 15A and an inner surface of the front thin lower plate 15B form the same plane without a step. On the other hand, an outer surface of the rear thick lower plate 15A and an outer surface of the front thin lower plate 15B form a step according to a difference in plate thickness, and in this stepped portion, a V-shaped groove 15C having a groove angle θ without a root face or a gap is formed.

Figure 24:
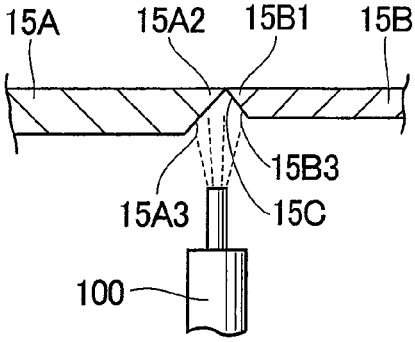
FIG. 24 is a sectional view illustrating a state of butt welding of the rear thick lower plate and the front thin lower plate at the position of the V-shaped groove.

As illustrated in FIG. 24, butt welding is performed at the position of the V-shaped groove 15C by using the welding torch 100 and the like. As a result, the front thin lower plate joining part 15A2 of the rear thick lower plate 15A and the rear thick lower plate joining part 15B1 of the front thin lower plate 15B are joined in a perfect welding state, and the lower plate 15 made of the rear thick lower plate 15A and the front thin lower plate 15B is formed.

Subsequently, designated at 16 is a thick rear plate as a rear plate constituting a rear surface of the arm 11. This thick rear plate 16 is formed having a rectangular plate shape using a plate material such as a steel plate and the like, and a center part in the length direction is bent in a mountain shape (See FIG. 5). A plate thickness 16*t* of this thick rear plate 16 is equal to or larger than the plate thickness 12At of the rear thick side plate 12A constituting the left side plate 12, the plate thickness 13At of the rear thick side plate 13A constituting the right side plate 13, the plate thickness 14At of the rear thick upper plate 14A constituting the upper plate 14, and the plate thickness 15At of the rear thick lower plate 15A constituting the lower plate 15 and they are set as in the following formula 6:

$$16t \geq 12At, 13At, 14At, 15At \quad \text{[Formula 6]}$$

Here, the thick rear plate 16 is joined to the rear end sides of the left and right side plates 12 and 13 and the upper plate 14 by welding and closes the rear end of the hollow arm 11. In this case, the thick rear plate 16 is joined to the rear plate joining part 12A3 of the rear thick side plate 12A constituting the left side plate 12, the rear plate joining part 13A3 of the rear thick side plate 13A constituting the right side plate 13, and the rear plate joining part 14A1 of the rear thick upper plate 14A constituting the upper plate 14 by welding. The front end edge of the thick rear plate 16 becomes a boom connecting boss joining part 16A to be joined to the boom connecting boss 18 which will be described later. The arm cylinder bracket 22 which will be described later is configured to be fixed to an outer surface of the thick rear plate 16.

Fillet welding is applied between the upper plate joining part 12A1 of the rear thick side plate 12A constituting the left side plate 12 and the upper plate 14. Similarly, fillet welding is applied between the upper plate joining part 12B1 of the front thin side plate 12B and the upper plate 14. On the other hand, fillet welding is applied between the upper plate joining part 13A1 of the rear thick side plate 13A constituting the right side plate 13 and the upper plate 14. Similarly, fillet welding is applied between the upper plate joining part 13B1 of the front thin side plate 13B and the upper plate 14. As a result, the upper plate 14 is firmly joined to the upper ends of the left and right side plates 12 and 13.

Moreover, fillet welding is applied between the lower plate joining part 12A2 of the rear thick side plate 12A constituting the left side plate 12 and the lower plate 15. Similarly, fillet welding is applied between the lower plate joining part 12B2 of the front thin side plate 12B and the lower plate 15. On the other hand, fillet welding is applied between the lower plate joining part 13A2 of the rear thick side plate 13A constituting the right side plate 13 and the lower plate 15. Similarly, fillet welding is applied between the lower plate joining part 13B2 of the front thin side plate 13B and the lower plate 15. As a result, the lower plate 15 is firmly joined to the lower ends of the left and right side plates 12 and 13.

Moreover, fillet welding is applied between the rear plate joining part 12A3 of the rear thick side plate 12A constituting the left side plate 12 and the thick rear plate 16. Similarly, fillet welding is applied between the rear plate joining part 13A3 of the rear thick sideplate 13A constituting the right side plate 13 and the thick rear plate 16. Moreover, fillet welding is applied between the rear plate joining part 14A1 of the rear thick upper plate 14A constituting the upper plate 14 and the thick rear plate 16. As a result, the thick rear plate 16 is firmly joined to the rear end sides of the left and right side plates 12 and 13 and the upper plate 14.

Figure 2:
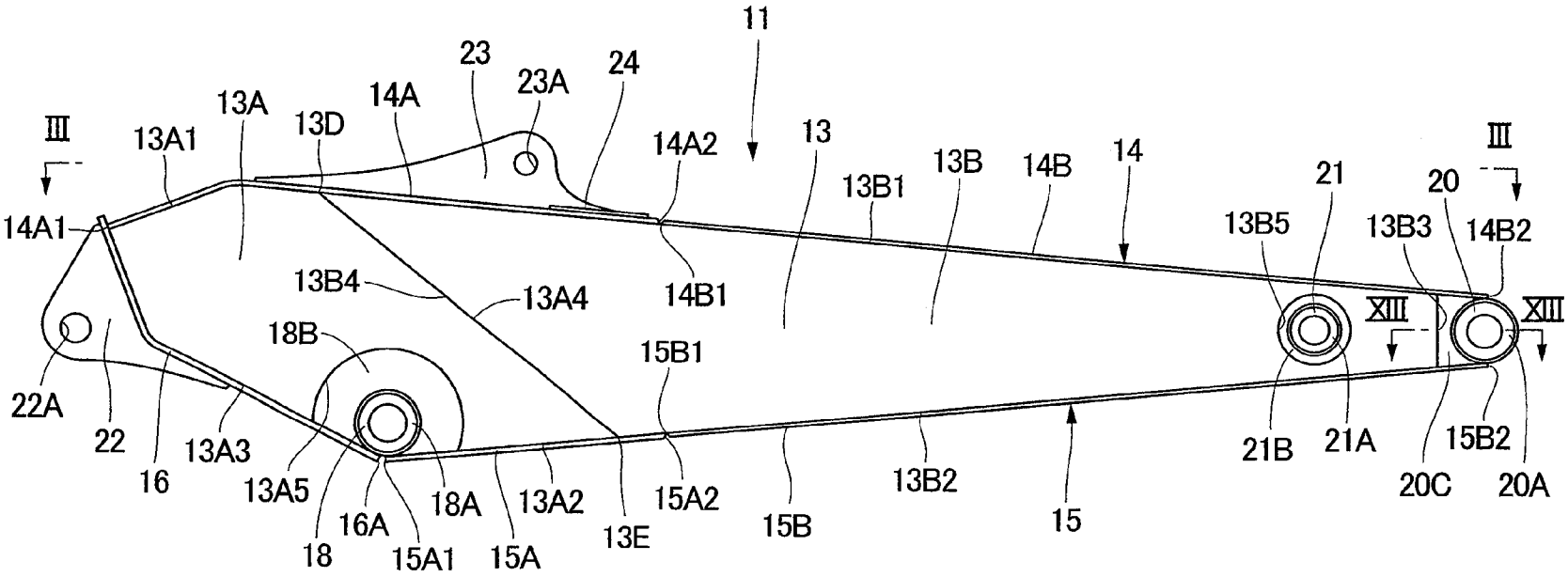
FIG. 2 is a front view illustrating the arm as a single unit.
Figure 3:
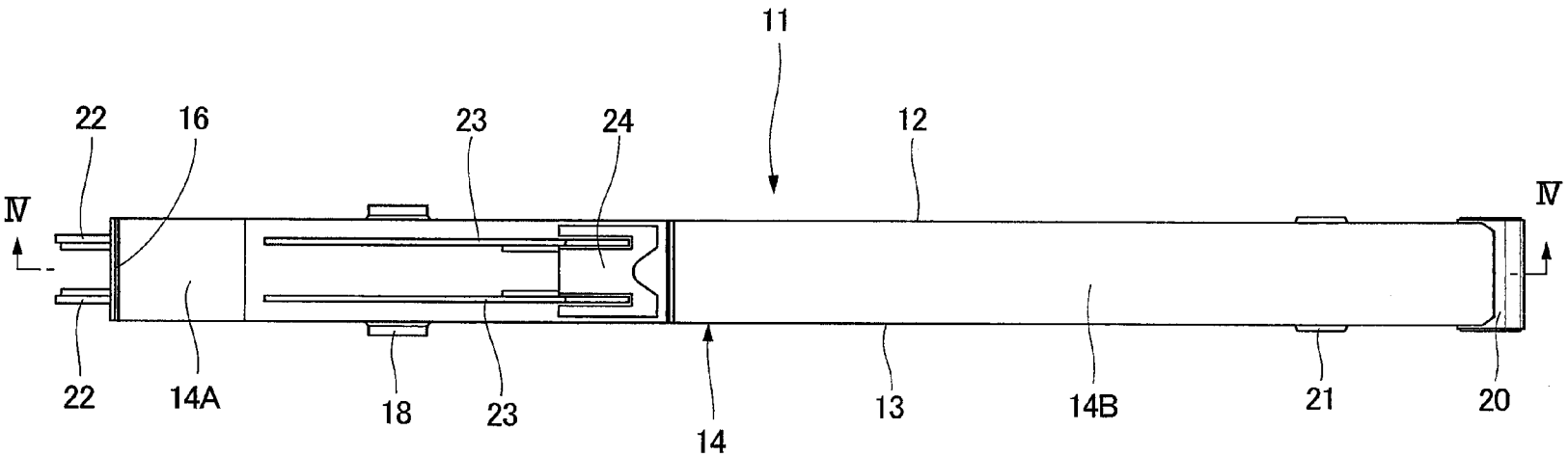
FIG. 3 is a plan view of the arm seen from an arrow III-III direction in FIG. 2.

Here, as illustrated in FIGS. 4 and 5, an upper end 12D of a joint portion between the rear thick side plate 12A and the front thin side plate 12B constituting the left side plate 12 is joined at a position of an intermediate portion of the rear thick upper plate 14A, and a lower end 12E of the joint portion is joined at a position on the front side of the rear thick lower plate 15A. On the other hand, as illustrated in FIG. 2, regarding the joint portion between the rear thick side plate 13A and the front thin side plate 13B constituting the right side plate 13, the upper end 13D is joined at the intermediate portion of the rear thick upper plate 14A, and a lower end 13E of the joint portion is joined at a position on the front part side of the rear thick lower plate 15A.

Designated at 17 is left and right backing materials provided between the rear thick side plate 12A of the left side plate 12 and the thick rear plate 16 and between the rear thick side plate 13A of the right side plate 13 and the thick rear plate 16, respectively. Each of the backing materials 17 is formed by bending an elongated square material into a mountain shape, respectively, for example, and is fixed to inner surfaces of the rear plate joining parts 12A3 and 13A3 of the rear thick side plates 12A and 13A by spot welding and the like, respectively.

It is configured such that a space between the rear plate joining part 12A3 of the rear thick side plate 12A constituting the left side plate 12 and the thick rear plate 16 is fillet-welded by using the backing material 17, and a space between the rear plate joining part 13A3 of the rear thick side plate 13A constituting the right side plate 13 and the thick rear plate 16 is fillet-welded by using the backing material 17. As a result, these fillet welding parts become perfect welding.

Subsequently, designated at 18 is a boom connecting boss provided on the rear parts on the lower sides of the left and right side plates 12 and 13. A connecting pin (not shown) rotabaly connecting the boom 5 and the arm 11 is inserted into this boom connecting boss 18. Here, the boom connecting boss 18 is composed of a hollow cylindrical boss portion 18A extending in the left-and-right direction and left and right flange portions 18B made of arc shaped flat plates provided on both end sides in the left-and-right direction of the cylindrical boss portion 18A.

The cylindrical boss portion 18A of the boom connecting boss 18 is joined to the boom connecting boss joining part 15A1 of the rear thick lower plate 15A and to the boom connecting boss joining part 16A of the thick rear plate 16 by welding. The left side flange portion 18B of the boom connecting boss 18 is joined to the boom connecting boss joining groove 12A5 of the rear thick side plate 12A, and the right side flange portion 18B is joined to the boom connecting boss joining groove 13A5 of the rear thick side plate 13A.

Designated at 19 is an internal partition wall provided between the inner surface of the rear thick upper plate 14A of the upper plate 14 and the boom connecting boss 18. This internal partition wall 19 is arranged so as to form two closed spaces in the arm 11 and improves rigidity of the arm 11. This internal partition wall 19 is formed of a rectangular flat plate having a width dimension in the left-and-right direction substantially equal to an interval between the left and right side plates 12 and 13.

Here, as illustrated in FIGS. 4 and 5, the upper end 19A of the internal partition wall 19 is joined to a position close to a joint portion between the rear thick upper plate 14A and the front thin upper plate 14B by welding. A lower end 19B of the internal partition wall 19 is joined to the cylindrical boss portion 18A of the boom connecting boss 18 by welding. Here, the upper end 19A of the internal partition wall 19 is joined to the inner surface 14A5 of the rear thick upper plate 14A at a position on the front side of a pin insertion hole 23A of the bucket cylinder bracket 23 which will be described later, that is, a position on the front side of the connecting pin 10A to which the bucket cylinder 10 is connected. On the other hand, a left side end 19C of the internal partition wall 19 is joined to the rear thick side plate 12A of the left side plate 12 and the front thin side plate 12B by welding, and the right side end 19C is joined to the rear thick side plate 13A of the right side plate 13 and the front thin side plate 13B by welding.

Designated at 20 is a bucket connecting boss provided on the front ends of the left and right side plates 12 and 13, the upper plate 14 and the lower plate 15. A connecting pin (not shown) rotatably connecting the bucket 6 and the arm 11 is inserted into the bucket connecting boss 20. This bucket connecting boss 20 is composed of a hollow cylindrical boss portion 20A extending in the left-and-right direction and left flange portion 20B and a right flange portion 20C each having a flat plate shape provided on the both end sides in the left-and-right direction of the cylindrical boss portion 20A.

On the rear end of the left flange portion 20B, the groove 20B1 is provided, and the groove 20B1 is abutted to the front side groove 12B7 provided on the front thin side plate 12B. Here, as illustrated in FIGS. 13 to 16, the groove 20B1 is formed as a uniform inclined surface without a root face by cutting out a rear end edge of the left flange portion 20B with inclination toward the inner surface side.

Figure 15:
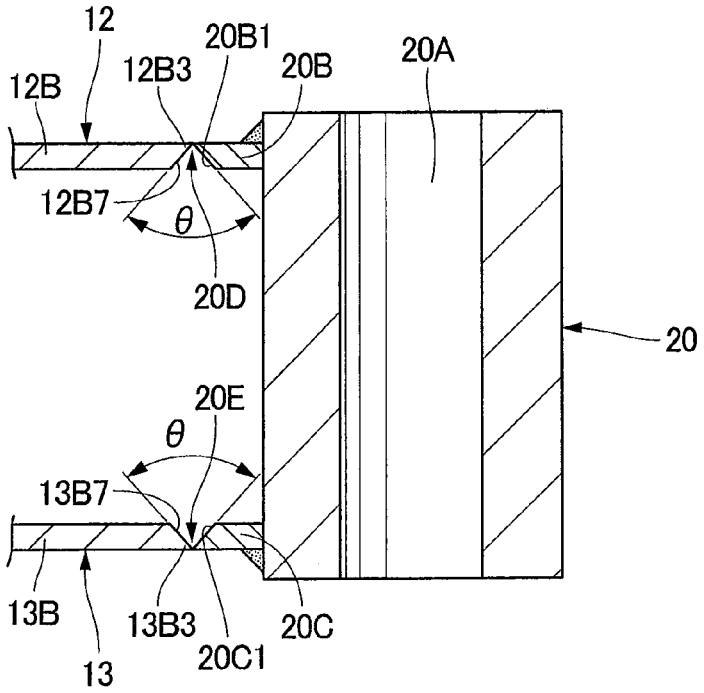
FIG. 15 is a sectional view illustrating a V-shaped groove formed by the groove of the front thin side plate and the groove of the flange portion of the bucket connecting boss.

In this case, the left flange portion 20B has a plate thickness substantially equal to the plate thickness 12Bt of the front thin side plate 12B. Therefore, as illustrated in FIG. 15, by abutting the front side groove 12B7 of the front thin side plate 12B and the groove 20B1 of the left flange portion 20B without a gap, the outer surface of the front thin side plate 12B and an outer surface of the left flange portion 20B form the same plane without a step. On the other hand, on the inner surface sides of the front thin side plate 12B and the left flange portion 20B, the V-shaped groove 20D having a groove angle θ without a root face or a gap is formed.

Figure 16:
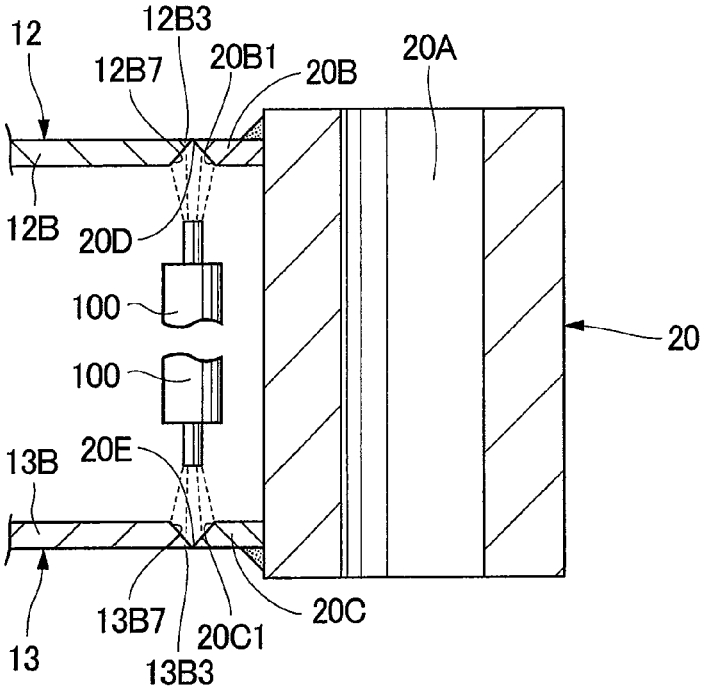
FIG. 16 is a sectional view illustrating a state of butt welding of the front thin side plate and the flange portion of the bucket connecting boss at the position of the V-shaped groove.

As illustrated in FIG. 16, by performing butt welding at the position of the V-shaped groove 20D by using the welding torch 100 and the like, the bucket connecting boss joining part 12B3 of the front thin side plate 12B and the left flange portion 20B of the bucket connecting boss 20 are joined in a perfect welding state.

On the rear end of the right flange portion 20C, the groove 20C1 is provided, and the groove 20C1 is to be abutted to the front side groove 13B7 provided on the front thin side plate 13B. Here, the groove 20C1 is formed by cutting out the rear end edge of the right flange portion 20C with inclination toward the inner surface side and is formed as a uniform inclined surface without a root face.

In this case, the right flange portion 20C has a plate thickness substantially equal to the plate thickness 13Bt of the front thin side plate 13B. Therefore, by abutting the front side groove 13B7 of the front thin side plate 13B and the groove 20C1 of the right flange portion 20C without a gap, the outer surface of the front thin side plate 13B and an outer surface of the right flange portion 20C form the same plane without a step. On the other hand, on the inner surface sides of the front thin side plate 133 and the right flange portion 20C, the V-shaped groove 20E having a groove angle θ without a root face or a gap is formed.

By performing butt welding at the position of the V-shaped groove 20E by using the welding torch 100 and the like, the bucket connecting boss joining part 13B3 of the front thin side plate 13B and the right flange portion 20C of the bucket connecting boss 20 are joined in a perfect welding state.

The cylindrical boss portion 20A of the bucket connecting boss 20 is joined to the bucket connecting boss joining part 14B2 of the front thin upper plate 14B constituting the upper plate 14 and to the bucket connecting boss joining part 15B2 of the front thin lower plate 15B constituting the lower plate 15 by welding.

Designated at 21 is the rear link connecting boss provided on the front end sides of the left and right side plates 12 and 13 adjacent to the bucket connecting boss 20. A connecting pin (not shown) rotatably connecting the rear link 7A of the bucket link 7 and the arm 11 is inserted into this rear link connecting boss 21. Here, the rear link connecting boss 21 is composed of a hollow cylindrical boss portion 21A extending in the left-and-right direction and disc-shaped left and right flange portions 21B provided on the both end sides in the left-and-right direction of the cylindrical boss portion 21A. The left side flange portion 21B of the rear link connecting boss 21 is joined to the rear link connecting boss joining hole 12B5 of the front thin side plate 12B, and the right side flange portion 21B is joined to the rear link connecting boss joining hole 13B5 of the front thin side plate 13B.

Designated at 22 is a pair of arm cylinder brackets provided on the outer surface of the thick rear plate 16, and each of the arm cylinder brackets 21 is arranged forming a pair in the left-and-right direction. To each of the arm cylinder brackets 22, a rod distal end of the arm cylinder 9 is rotatably connected through a connecting pin (not shown). Here, each of the arm cylinder brackets 22 is formed having a substantially triangular plate body by using a plate material such as a steel plate and the like, and a pin insertion hole 22A through which the above-described connecting pin is inserted is drilled in the center part thereof. Moreover, each of the arm cylinder brackets 22 is joined to the outer surface of the thick rear plate 16 by welding in a state where a certain interval is kept in the left-and-right direction.

Designated at 23 is a pair of bucket cylinder brackets provided on the outer surface 14A4 of the rear thick upper plate 14A constituting the upper plate 14. Each of the bucket cylinder brackets 23 is arranged forming a pair in the left-and-right direction, and the bottom side of the bucket cylinder 10 is rotatably connected thereto through the connecting pin 10A. Here, each of the bucket cylinder brackets 23 is formed as a substantially triangular plate body by using a plate material such as a steel plate and the like, and a pin insertion hole 23A through which the above-described connecting pin 10A is inserted is drilled on the distal end side thereof. Moreover, each of the bucket cylinder brackets 23 is joined to the outer surface 14A4 of the rear thick upper plate 14A by welding in a state where a certain interval is kept in the left-and-right direction.

Figure 25:
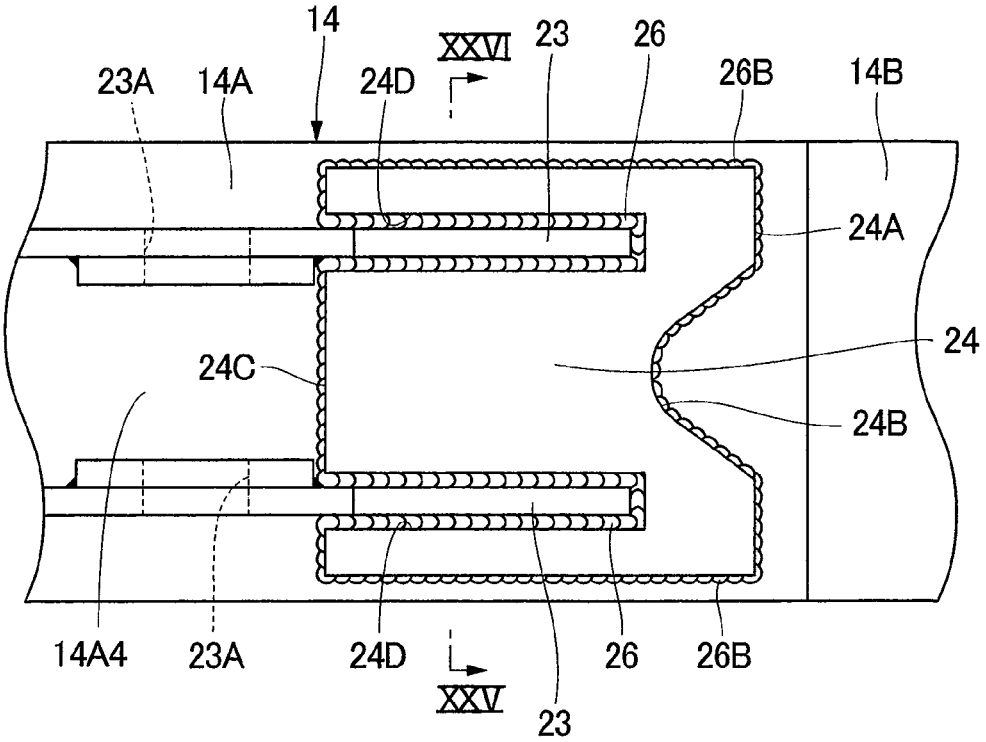
FIG. 25 is an enlarged view of an essential part illustrating the upper plate, the bucket cylinder bracket, and the auxiliary welding member in FIG. 3 in an enlarged manner.
Figure 26:
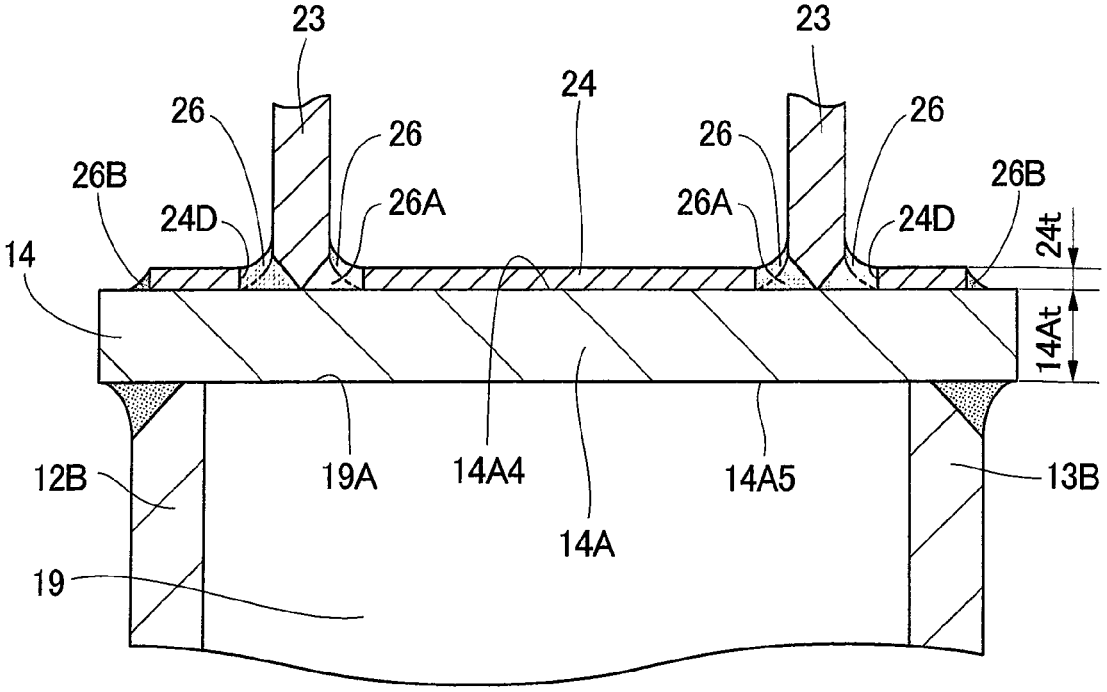
FIG. 26 is a sectional view of the upper plate, the bucket cylinder bracket, and a welded portion of the auxiliary welding member seen from an arrow XXVI-XXVI direction in FIG. 25.

Subsequently, designated at 24 is an auxiliary welding member provided on the rear side of the upper plate 14. This auxiliary welding member 24 is provided on the outer surface 14A4 of the rear thick upper plate 14A so as to surround a welded portion between the rear thick upper plate 14A of the upper plate 14 and each of the bucket cylinder brackets 23. Here, as illustrated in FIGS. 25 and 26, the auxiliary welding member 24 is formed as a flat plate having a substantially M-shape on a plan view from above. That is, the auxiliary welding member 24 is made of a square flat plate having a width dimension slightly smaller than a width dimension in the left-and-right direction of the rear thick upper plate 14A as a whole. This auxiliary welding member 24 has a notched portion 24B located in the middle of the left-and-right direction and cut out having a recessed shape rearward from a front end 24A and a pair of groove portions 24D extending forward from a rear end 24C.

Here, the periphery (outer peripheral edge portion) of the auxiliary welding member 24 is fillet-welded to the outer surface 14A4 of the rear thick upper plate 14A over the entire periphery. As a result, as illustrated in FIG. 26, the plate thickness 14At of the rear thick upper plate 14A is superimposed with a plate thickness 24*t* of the auxiliary welding member 24 so that the plate thickness of a portion in the rear thick upper plate 14A where the bucket cylinder bracket 23 is joined can be partially made thicker in configuration.

As illustrated in FIG. 5, the front end 24A of the auxiliary welding member 24 is arranged on the front side of the pin insertion hole 23A of the bucket cylinder bracket 23, and the rear end 24C of the auxiliary welding member 24 is arranged on the rear side of the upper end 19A of the internal partition wall 19. As described above, the auxiliary welding member 24 is arranged so as to extend in the fore-and-rear direction while sandwiching the upper end 19A of the internal partition wall 19.

Figure 27:
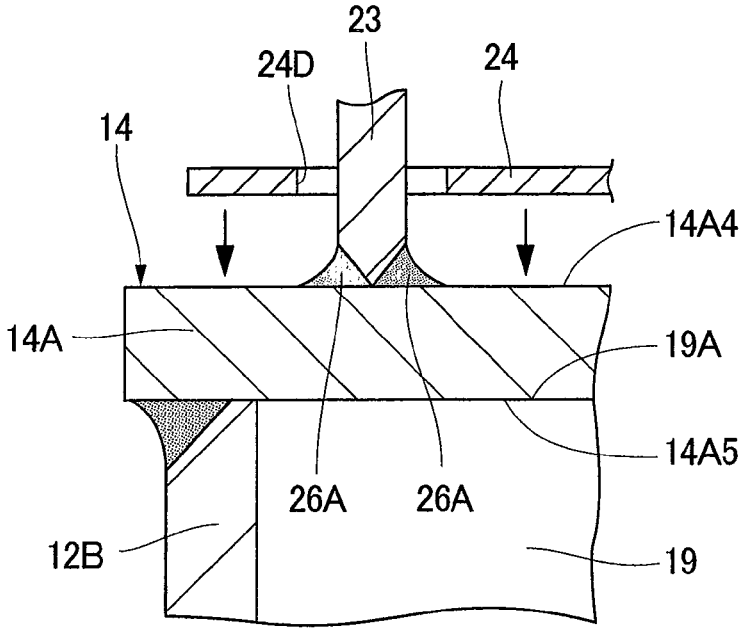
FIG. 27 is a sectional view illustrating a state where the auxiliary welding member is arranged in the vicinity of the welded portion between the upper plate and the bucket cylinder bracket.
Figure 28:
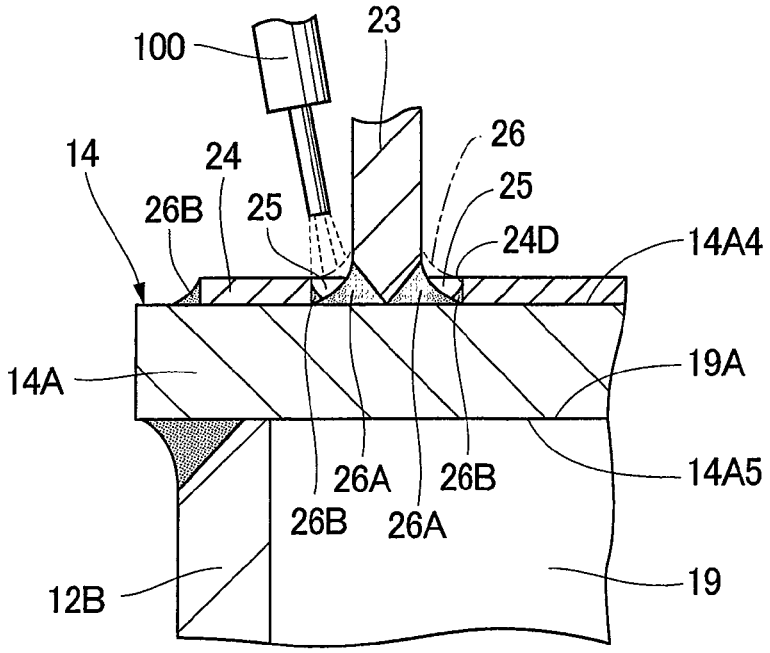
FIG. 28 is a sectional view illustrating a state where a welding bead between the upper plate and the bucket cylinder bracket and the auxiliary welding member are welded.

On the other hand, as illustrated in FIGS. 27 and 28, a bracket-side welding bead 26A constituting the welding bead 26 which will be described later is formed on a joint portion between the outer surface 14A4 of the rear thick upper plate 14A and the bucket cylinder bracket 23. Here, in a state where the groove portion 24D of the auxiliary welding member 24 is inserted into the front part side of the bucket cylinder bracket 23, a gap 25 is formed between the groove portion 24D of the auxiliary welding member 24 and the bucket cylinder bracket 23.

In this state, to the peripheral edge portion of the groove portion 24D provided on the auxiliary welding member 24, fillet welding is applied by using the welding torch 100, for example. Therefore, the bracket-side welding bead 26A formed between the bucket cylinder bracket 23 and the rear thick upper plate 14A and an auxiliary welding member side welding bead 26B formed between the groove portion 24D of the auxiliary welding member 24 and the rear thick upper plate 14A are integrated so that the welding bead 26 is formed. The gap 25 formed between the groove portion 24D of the auxiliary welding member 24 and the bucket cylinder bracket 23 can be embedded in this welding bead 26.

As a result, as illustrated in FIG. 26, each of the groove portions 24D of the auxiliary welding member 24 and each of the bucket cylinder brackets 23 can be joined together with the smoothly continuing welding bead 26. On the other hand, by applying fillet welding to the periphery of the notched portion 24B provided on the front end 24A of the auxiliary welding member 24, a welding length of the auxiliary welding member 24 with respect to the rear thick upper plate 14A can be ensured large.

The arm 11 according to this embodiment has the configuration as described above, and an example of a procedure of manufacturing this arm 11 will be described by referring to FIG. 8.

Figure 10:
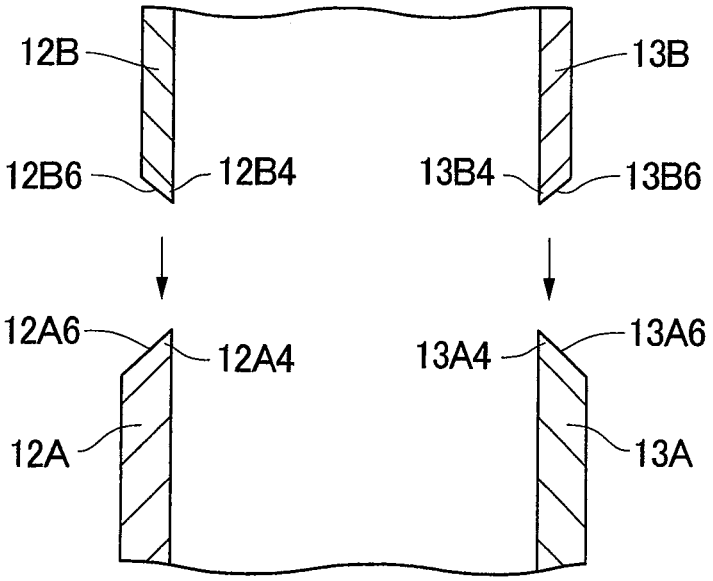
FIG. 10 is a sectional view illustrating a groove of the rear thick side plate and a groove of the front thin side plate.

First, as illustrated in FIGS. 10 and 11, the groove 12A6 of the rear thick side plate 12A constituting the left side plate 12 and the rear side groove 12B6 of the front thin side plate 12B are abutted to each other so as to form the V-shaped groove 12C, and butt welding is performed by using means such as arc welding and the like at the position of this V-shaped groove 12C. In this case, since the V-shaped groove 12C does not have a root face or a gap, arcs from the welding torch 100 can be supplied to the whole surface of each of the grooves 12A6 and 12B6. As a result, perfect welding can be performed such that the rear thick side plate 12A and the front thin side plate 12B are blended over the entire region of the plate thickness.

Moreover, since the groove angle θ of the V-shaped groove 12C is set within a range of 43 degrees of more and 90 degrees or less, arc heat can be sufficiently supplied to each of the grooves 12A6 and 12B6, and the inside of the V-shaped groove 12C can be filled with molten metal without excess or shortage. Thus, as illustrated in FIG. 9, a welding bead 12F smoothly continuing between the rear thick side plate 12A and the front thin side plate 12B can be formed. As a result, the left side plate 12 in which the rear thick side plate 12A and the front thin side plate 12B are firmly joined can be formed without arranging a backing material and the like on the back side of the V-shaped groove 12C.

Similarly to the above, the groove 13A6 of the rear thick side plate 13A constituting the right side plate 13 and the rear side groove 13B6 of the front thin side plate 13B are abutted to each other so as to form the V-shaped groove 13C, and butt welding is performed at the position of this V-shaped groove 13C. As a result, a welding bead 13F smoothly continuing between the rear thick side plate 13A and the front thin side plate 13B can be formed, and the right side plate 13 in which the rear thick side plate 13A and the front thin side plate 13B are firmly joined can be formed.

Subsequently, the left and right flange portions 18B of the boom connecting boss 18 are joined to the boom connecting boss joining groove 12A5 of the left side plate 12 and the boom connecting boss joining groove 13A5 of the right side plate 13 by welding, respectively. Moreover, the left and right flange portions 21B of the rear link connecting boss 21 are joined to the rear link connecting boss joining hole 12B5 of the left side plate 12 and the rear link connecting boss joining hole 13B5 of the right side plate 13 by welding, respectively.

Figure 14:
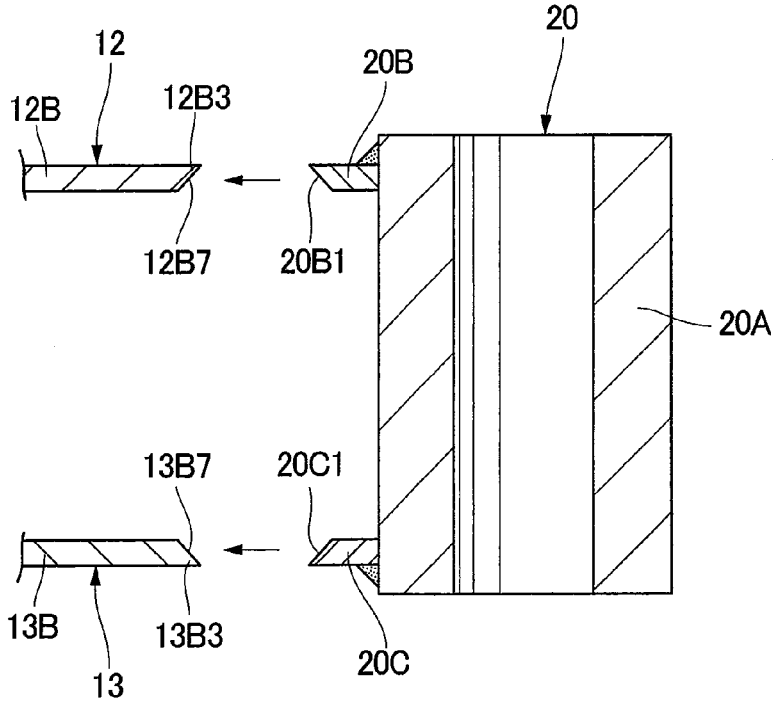
FIG. 14 is a sectional view illustrating a groove of the front thin side plate and a groove of a flange portion of the bucket connecting boss.

Subsequently, as illustrated in FIGS. 14 and 15, the front side groove 12B7 of the front thin side plate 12B constituting the left side plate 12 and the groove 20B1 of the left flange portion 20B constituting the bucket connecting boss 20 are abutted so as to form the V-shaped groove 20D, and butt welding is performed at the position of this V-shaped groove 20D. As a result, a welding bead 20F smoothly continuing between the front thin side plate 12B and the left flange portion 20B can be formed, and the front thin side plate 12B and the left flange portion 20B can be firmly joined.

On the other hand, the front side groove 13B7 of the front thin side plate 13B constituting the right side plate 13 and the groove 20C1 of the right flange portion 20C constituting the bucket connecting boss 20 are abutted so as to form the V-shaped groove 20E, and butt welding is performed at the position of this V-shaped groove 20E. As a result, a welding bead 20G smoothly continuing between the front thin side plate 13B and the right flange portion 20C can be formed, and the front thin side plate 13B and the right flange portion 20C can be firmly joined.

Figure 18:
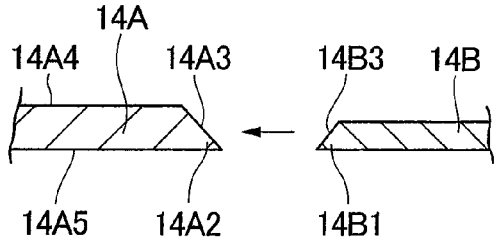
FIG. 18 is a sectional view illustrating a groove of the rear thick upper plate and the groove of the front thin upper plate.

Subsequently, as illustrated in FIGS. 18 and 19, the groove 14A3 of the rear thick upper plate 14A and the groove 14B3 of the front thin upper plate 14B are abutted so as to form the V-shaped groove 14C, and butt welding is performed at the position of this V-shaped groove 14C. As a result, a welding bead 14D smoothly continuing between the rear thick upper plate 14A and the front thin upper plate 14B can be formed, and the upper plate 14 in which the rear thick upper plate 14A and the front thin upper plate 14B are firmly joined can be formed.

Figure 22:
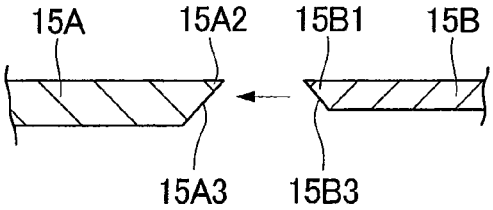
FIG. 22 is a sectional view illustrating a groove of the rear thick lower plate and a groove of the front thin lower plate.

Moreover, as illustrated in FIGS. 22 and 23, the groove 15A3 of the rear thick lower plate 15A and the groove 15B3 of the front thin lower plate 15B are abutted so as to form the V-shaped groove 15C, and butt welding is performed at the position of this V-shaped groove 15C. As a result, a welding bead 15D smoothly continuing between the rear thick lower plate 15A and the front thin lower plate 15B can be formed, and the lower plate 15 in which the rear thick lower plate 15A and the front thin lower plate 15B are firmly joined can be formed.

Subsequently, the upper plate 14 is arranged on the upper sides of the left side plate 12 and the right side plate 13, and fillet welding is applied over the whole length between the left side plate 12 and the upper plate 14. Similarly, fillet welding is applied over the whole length between the right side plate 13 and the upper plate 14. Moreover, the bucket connecting boss joining part 14B2 of the front thin upper plate 14B constituting the upper plate 14 is joined to the cylindrical boss portion 20A of the bucket connecting boss 20 by welding. As a result, the upper plate 14 can be joined to the upper end sides of the left and right side plates 12 and 13.

On the other hand, the internal partition wall 19 is prepared, and the upper end 19A of this internal partition wall 19 is welded to a portion close to the front thin upper plate joining part 14A2 of the rear thick upper plate 14A constituting the upper plate 14. In addition, the lower end 19B of the internal partition wall 19 is welded to the cylindrical boss portion 18A of the boom connecting boss 18. Moreover, the left side end 19C of the internal partition wall 19 is welded to the inner surfaces of the rear thick side plate 12A and the front thin side plate 12B of the left side plate 12, and the right side end 19C of the internal partition wall 19 is welded to the inner surfaces of the rear thick side plate 13A and the front thin side plate 13B of the right side plate 13.

Subsequently, a lower plate 15 is arranged on the lower end sides of the left side plate 12 and the right side plate 13, and fillet welding is applied to the whole length between the left side plate 12 and the lower plate 15. Similarly to this, fillet welding is applied to the whole length between the right side plate 13 and the lower plate 15. On the other hand, the boom connecting boss joining part 15A1 of the rear thick lower plate 15A is joined to the cylindrical boss portion 18A of the boom connecting boss 18 by welding. Moreover, the bucket connecting boss joining part 15B2 of the front thin lower plate 15B is joined to the cylindrical boss portion 20A of the bucket connecting boss 20 by welding. As a result, the lower plate 15 can be joined to the lower end sides of the left and right side plates 12 and 13.

The upper plate 14 is joined to the upper end sides of the left and right side plates 12 and 13 and the lower plate 15 is joined to the lower end sides, and then, the thick rear plate 16 is prepared. In a state where the backing material 17 fixed to the rear thick side plate 12A of the left side plate 12 and the thick rear plate 16 are brought into contact with each other, fillet welding is applied between the rear plate joining part 12A3 of the rear thick side plate 12A and the thick rear plate 16. In a state where the backing material 17 fixed to the rear thick side plate 13A of the right side plate 13 and the thick rear plate 16 are brought into contact with each other, fillet welding is applied between the rear plate joining part 13A3 of the rear thick side plate 13A and the thick rear plate 16. On the other hand, fillet welding is applied between the rear plate joining part 14A1 of the rear thick upper plate 14A constituting the upper plate 14 and the thick rear plate 16, and the boom connecting boss joining part 16A of the thick rear plate 16 is welded to the cylindrical boss portion 18A of the boom connecting boss 18.

Subsequently, a pair of left and right bucket cylinder brackets 23 are joined to the outer surface of the rear thick upper plate 14A constituting the upper plate 14 by welding. Moreover, the auxiliary welding member 24 is provided on the outer surface 14A4 of the rear thick upper plate 14A so as to surround a welded portion between the rear thick upper plate 14A and each bucket cylinder bracket 23. In this state, an outer peripheral edge of the auxiliary welding member 24 is fillet-welded to the outer surface 14A4 of the rear thick upper plate 14A over the entire periphery. As a result, as illustrated in FIG. 26, the plate thickness 24*t* of the auxiliary welding member 24 can be superimposed with the plate thickness 14At of the rear thick upper plate 14A, and a plate thickness of the portion in the rear thick upper plate 14A where the bucket cylinder bracket 23 is joined can be partially made thicker.

In this case, as illustrated in FIGS. 27 and 28, the bracket-side welding bead 26A is formed on a joint portion between the outer surface 14A4 of the rear thick upper plate 14A and the bucket cylinder bracket 23. On the other hand, a gap 25 is formed between the groove portion 24D of the auxiliary welding member 24 and the bucket cylinder bracket 23.

In this state, fillet welding is applied to the peripheral edge of the groove portion 24D provided on the auxiliary welding member 24 by using the welding torch 100. Therefore, the welding bead 26 in which the bracket-side welding bead 26A formed between the bucket cylinder bracket 23 and the rear thick upper plate 14A and the auxiliary welding member side welding bead 26B formed between the groove portion 24D of the auxiliary welding member 24 and the rear thick upper plate 14A are blended can be formed. This welding bead 26 fills the gap 25 formed between the groove portion 24D of the auxiliary welding member 24 and the bucket cylinder bracket 23. As a result, each groove portion 24D of the auxiliary welding member 24 and each bucket cylinder bracket 23 can be joined to each other by the smoothly continuing welding bead 26.

Then, the arm 11 having a cross sectional surface in a square closed sectional structure can be formed by welding the left and right side plates 12 and 13, the upper plate 14, the lower plate 15, the thick rear plate 16 and the like to each other.

In this case, according to this embodiment, the upper plate 14 is formed by joining the rear thick upper plate 14A having the large plate thickness 14At and the front thin upper plate 14B having the small plate thickness 14Bt by welding, and the bucket cylinder bracket 23 to which the bucket cylinder 10 is connected is joined to the outer surface of the rear thick upper plate 14A.

As described above, the rear side in the upper plate 14 requiring large strength can be constituted by the rear thick upper plate 14A, and the front side not requiring large strength as compared with the rear side can be constituted by the front thin upper plate 14B. Therefore, required strength can be ensured by the rear thick upper plate 14A on the rear side of the arm 11, and the weight reduction can be realized by the front thin upper plate 14B on the front side of the arm 11. As a result, weight reduction of the entire arm 11 can be realized while required strength is ensured as compared with the case in which an upper plate is constituted by using a single plate material having a uniform plate thickness.

On the other hand, the lower plate 15 is also formed by joining the rear thick lower plate 15A having the large plate thickness 15At and the front thin lower plate 15B having the small plate thickness 15Bt by welding. Further, the left side plate 12 is also formed by joining the rear thick side plate 12A having the large plate thickness 12At and the front thin side plate 12B having the small plate thickness 12Bt by welding, and the right side plate 13 is also formed by joining the rear thick side plate 13A having the large plate thickness 13At and the front thin side plate 13B having the small plate thickness 13Bt by welding.

As a result, on the rear part side of the arm 11 where the boom connecting boss 18, the arm cylinder bracket 22, the bucket cylinder bracket 23 and the like are provided, required strength can be ensured by the rear thick lower plate 15A and the left and right rear thick side plates 12A and 13A. On the other hand, on the front part side of the arm 11, weight reduction can be realized by the front thin lower plate 15B and the left and right front thin side plates 12B and 13B. Therefore, as compared with the case in which the lower plate and each side plate are constituted by using a single plate material having a uniform plate thickness, further weight reduction of the entire arm 11 can be realized while required strength is ensured.

Moreover, as illustrated in FIG. 4, regarding the joint portion between the rear thick side plate 12A and the front thin side plate 12B of the left side plate 12, the upper end 12D of this joint portion is configured to be joined to the rear thick upper plate 14A of the upper plate 14, and the lower end 12E of the joint portion to the rear thick lower plate 15A of the lower plate 14. On the other hand, as illustrated in FIG. 2, regarding the joint portion between the rear thick side plate 13A and the front thin side plate 13B of the right side plate 13, the upper end 13D of this joint portion is configured to be joined to the rear thick upper plate 14A of the upper plate 14, and the lower end 13E of the joint portion to the rear thick lower plate 15A of the lower plate 14.

As a result, strength of the joint portion between the rear thick side plate 12A and the front thin side plate 12B of the left side plate 12 can be improved and at the same time, strength of the joint portion between the rear thick side plate 13A and the front thin side plate 13B of the right side plate 13 can be improved, and strength of the entire arm 11 can be improved.

On the other hand, according to this embodiment, the internal partition wall 19 is configured to be provided among the left and right side plates 12 and 13, the boom connecting boss 18, and the upper plate 14. As a result, two closed spaces can be formed by the internal partition wall 19 in the arm 11, and rigidity of the entire arm 11 can be improved.

Further, according to this embodiment, the thick rear plate 16 is formed by using a plate material having a plate thickness equal to or larger than the rear thick side plates 12A and 13A of the left and right side plates 12 and 13, the rear thick upper plate 14A of the upper plate 14, and the rear thick lower plate 15A of the lower plate 15. Therefore, strength of the rear end of the arm 11 on which the arm cylinder bracket 22 is provided can be further improved.

On the other hand, according to this embodiment, joining strength between the rear thick side plate 12A and the front thin side plate 12B can be improved by forming the V-shaped groove 12C between the groove 12A6 provided on the rear thick side plate 12A of the left side plate 12 and the rear side groove 12B6 provided on the front thin side plate 12B of the left side plate 12.

Similarly to the above, joining strength between the rear thick side plate 13A and the front thin side plate 13B can be improved by forming the V-shaped groove 13C between the groove 13A6 provided on the rear thick side plate 13A of the right side plate 13 and the rear side groove 13B6 provided on the front thin side plate 133 of the right side plate 13.

On the other hand, the V-shaped groove 20D is formed between the front side groove 12B7 of the front thin side plate 12B and the groove 20B1 of the left flange portion 20B of the bucket connecting boss 20, and the V-shaped groove 20E is formed between the front side groove 13B7 of the front thin side plate 13B and the groove 20C1 of the right flange portion 20C of the bucket connecting boss 20. As a result, joining strength between the left side plate 12 and the left flange portion 20B of the bucket connecting boss 20 can be improved, and joining strength between the right side plate 13 and the right flange portion 20C of the bucket connecting boss 20 can be improved.

Further, the joining strength between the rear thick upper plate 14A and the front thin upper plate 14B can be improved by forming the V-shaped groove 14C between the groove 14A3 provided on the rear thick upper plate 14A of the upper plate 14 and the groove 14B3 provided on the front thin upper plate 14B.

Similarly to the above, the joining strength between the rear thick lower plate 15A and the front thin lower plate 15B can be improved by forming the V-shaped groove 15C between the groove 15A3 provided on the rear thick lower plate 15A of the lower plate 15 and the groove 15B3 provided on the front thin lower plate 15B.

On the other hand, according to this embodiment, fillet welding is applied over the entire periphery between the outer peripheral edge of the auxiliary welding member 24 and the rear thick upper plate 14A in configuration. Therefore, the plate thickness of the portion in the rear thick upper plate 14A where the bucket cylinder bracket 23 is joined can be made thicker only by the plate thickness of the auxiliary welding member 24. As a result, large deformation of the rear thick upper plate 14A and each bucket cylinder bracket 23 caused by load acting on each bucket cylinder bracket 23 can be suppressed, and durability of the entire arm 11 can be improved.

Furthermore, by applying fillet welding between the peripheral edge of the groove portion 24D provided on the auxiliary welding member 24 and the rear thick upper plate 14A, each groove portion 24D of the auxiliary welding member 24 and each bucket cylinder bracket 23 can be joined by the smoothly continuing welding bead 26. As a result, joining strength of each bucket cylinder bracket 23 to the rear thick upper plate 14A can be improved without increasing the plate thickness of each bucket cylinder bracket 23.

Figure 29:
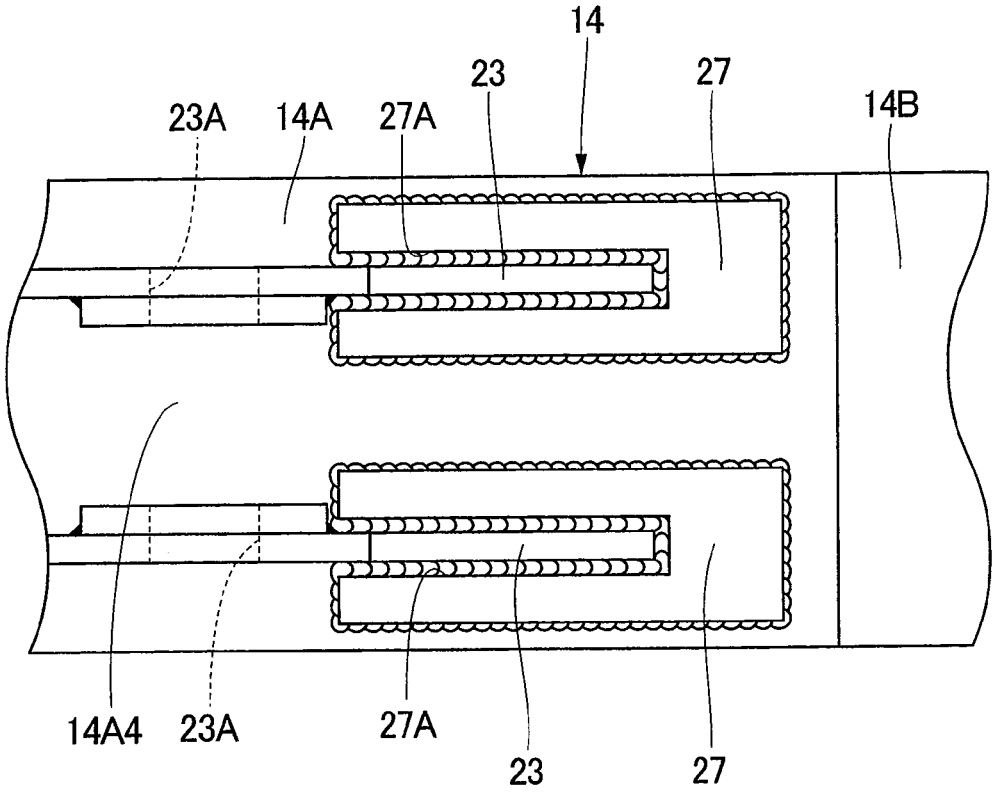
FIG. 29 is an enlarged view of an essential part similar to FIG. 25 illustrating a modification of the auxiliary welding member.

It should be noted that in the above-described embodiment, the case using the single M-shaped auxiliary welding member 24 having the notched portion 24B and the left and right groove portions 24D is exemplified. However, the present invention is not limited to the same and as in a variation illustrated in FIG. 29, for example, the auxiliary welding member 27 may be provided one each to the left and right bucket cylinder brackets 23, that is, two members in total in configuration. This auxiliary welding member 27 is formed of a rectangular flat plate extending in the fore-and-rear direction and in a state where the bucket cylinder bracket 23 is inserted through the single groove portion 27A extending in the fore-and-rear direction, its outer peripheral edge is fillet-welded to the outer surface 14A4 of the rear thick upper plate 14A over the entire periphery.

In the above-described embodiment, as one example of the procedure of assembling the arm 11, the boom connecting boss 18, the bucket connecting boss 20, and the rear link connecting boss 21 are joined to the left and right side plates 12 and 13 and then, the upper plate 14 is joined to each of the side plates 12 and 13. Subsequently, the case when the internal partition wall 19 is joined between the upper plate 14 and the boom connecting boss 18 and then, the lower plate 15 and the thick rear plate 16 are joined to each of the side plates 12 and 13, is exemplified. However, the assembling procedure of the arm 11 according to the present invention is not limited to the above-described embodiment, but the procedure of assembling the arm 11 can be changed as appropriate.

In the above-described embodiment, the configuration in which the backing material 17 is fixed to the rear thick side plates 12A and 13A constituting the left and right side plates 12 and 13, and fillet welding is applied between each of the rear thick side plates 12A and 13A and the thick rear plate 16 by using this backing material 17 is exemplified. However, the present invention is not limited to the same, it may be so configured that fillet welding is applied between each of the rear thick side plates 12A and 13A and the thick rear plate 16 without using the backing material 17.

Moreover, in the above-described embodiment, the crawler-type hydraulic excavator 1 is described as an example as the construction machine. However, the present invention is not limited to the same and can be widely applied to other arms for construction machine such as an arm used in a wheel-type hydraulic excavator and the like, for example.

DESCRIPTION OF REFERENCE NUMERALS

1: Hydraulic excavator (Construction machine)
10: Bucket cylinder
10A: Connecting pin
11: Arm
12: Left side plate
12A, 13A: Rear thick side plate
12A6, 13A6, 14A3, 14B3, 15A3, 15B3, 20B1, 20C1: Groove
12B, 13B: Front thin side plate
12B6, 13B6: Rear side groove (Groove)
12B7, 13B7: Front side groove (Groove)
12C, 13C, 14C, 15C, 20D, 20E: V-shaped groove
13: Right side plate
14: Upper plate
14A: Rear thick upper plate
14A4: Outer surface
14B: Front thin upper plate
15: Lower plate
15A: Rear thick lower plate
15B: Front thin lower plate
16: Thick rear plate
18: Boom connecting boss
19: Internal partition wall
19A: Upper end
20: Bucket connecting boss
20A: Cylindrical boss portion
20B: Left flange portion
20C: Right flange portion
23: Bucket cylinder bracket
24, 27: Auxiliary welding member
24A: Front end
24B: Notched portion
24C: Rear end
25: Gap
26: Welding bead
26A: Bracket-side welding bead
26B: Auxiliary welding member side welding bead

The invention claimed is:

1. An arm for a construction machine formed as a box-shaped structural body having a square cross sectional surface, having left and right side plates, an upper plate joined to upper end sides of said left and right side plates by welding, a lower plate joined to lower end sides of said left and right side plates by welding, and a rear plate joined to rear end sides of said left and right side plates and a rear end side of said upper plate by welding, comprising:

a boom connecting boss located on rear parts on the lower end sides of said left and right side plates and joined to the rear end sides of said left and right side plates and said lower plate and a front end of said rear plate by welding;

a bucket connecting boss joined to front ends of said left and right side plates, said upper plate, and said lower plate by welding; and a pair of left and right bucket cylinder brackets joined to an outer surface of said upper plate by welding , characterized in that;

said upper plate is formed by joining two members, that is, a rear, thick upper plate located on a rear side of said upper plate and made of a plate material having a large plate thickness and a front, thin upper plate located on a front side of said rear, thick upper plate and made of a plate material having a small plate thickness;

said lower plate is formed by joining two members, that is, a rear, thick lower plate located on a rear side of said lower plate and made of a plate material having a large plate thickness and a front, thin lower plate located on a front side of said rear thick lower plate and made of a plate material having a small plate thickness;

said left and right side plates are formed by joining two members, that is, a rear, thick side plate located on a rear side of each of said left and right plates and made of a plate material having a large plate thickness and a front, thin side plate located on a front side of each said rear, thick side plate and made of a plate material having a small plate thickness;

said pair of said left and right bucket cylinder brackets are configured to be joined to an outer surface of said rear, thick upper plate;

said boom connecting boss is configured to be joined to a rear end of said rear, thick lower plate;

a joint portion between said rear, thick side plate and said front, thin side plate, said joint portion being configured such that an upper end of said joint portion is joined to said rear, thick upper plate and a lower end of said joint portion is joined to said rear, thick lower plate;

an auxiliary welding member having a flat plate shape and provided on an outer surface of the rear part side of said upper plate so as to surround a welded portion between each of said pair of left and right bucket cylinder brackets and said upper plate; and a welding bead formed by applying fillet welding around said auxiliary welding member.

2. The arm for a construction machine according to claim 1, wherein an internal partition wall for reinforcement is provided between an inner surface side of said rear, thick upper plate and said boom connecting boss.

3. The arm for a construction machine according to claim 1, wherein said rear plate is formed as a thick rear plate using a plate material having a plate thickness equal to or larger than said rear, thick upper plate and said rear, thick side plates; and said thick rear plate is joined to rear ends of said left and right rear, thick side plates and a rear end of said rear, thick upper plate, and a front end of said thick rear plate is joined to said boom connecting boss.

4. The arm for a construction machine according to claim 1, wherein a groove extending in an upper-and-lower direction is provided in a front end of each of said rear, thick side plates and a rear end of each of said front, thin side plates by cutting away without a root face;

a V-shaped groove without a root face or a gap is formed by having said groove of each of said rear, thick side plates and said groove of each of said front, thin side plates abut each other; and a welding bead is formed by applying welding between each of said rear, thick side plates and each of said front, thin side plates at a position of said V-shaped groove.

5. The arm for a construction machine according to claim 1, wherein in said bucket connecting boss, flange portions located on both the left and right sides of a cylindrical boss portion and extending toward said left and right side plates are provided;

a first V-shaped groove extending in an upper-and-lower direction is provided on each of front ends of said left and right side plates, respectively by cutting away without a root face;

a second V-shaped groove extending in the upper-and-lower direction is provided on rear ends of said left and right flange portions of said bucket connecting boss, respectively by cutting away without a root face; and each of said first and second V-shaped grooves, without a root face or a gap, respectively, is formed by abutting said first V-shaped grooves of said left and right side plates and said second V-shaped grooves of said left and right flange portions, and each of welding beads is formed by applying welding between said left and right side plates and said left and right flange portions at the position of said first and second V-shaped grooves.

6. The arm for a construction machine according to claim 1, wherein a groove extending in a left-and-right direction is provided on each of the front side of said rear, thick upper plate and a rear end of said front, thin upper plate, respectively by cutting away without a root face;

a V-shaped groove without a root face or a gap is formed by abutting said groove of said front side of said rear, thick upper plate and said groove of said rear side of said front, thin upper plate; and a welding bead is formed by applying welding between said rear, thick upper plate and said front, thin upper plate at the position of said V-shaped groove.

7. The arm for a construction machine according to claim 1, wherein a groove extending in a left-and-right direction is provided on the front side of said rear, thick lower plate and a rear end of said front, thin lower plate, respectively by cutting away without a root face;

a V-shaped groove without a root face or a gap is formed by abutting said groove of said front side of said rear, thick lower plate and said groove of said rear side of said front, thin lower plate; and a welding bead is formed by applying welding between said rear, thick lower plate and said front, thin lower plate at the position of said V-shaped groove.

8. The arm for a construction machine according to claim 4, wherein a groove angle of said V-shaped groove is configured to be set within a range of 43 degrees or more and 90 degrees or less.

9. The arm for a construction machine according to claim 1, wherein an internal partition wall for reinforcement is provided between said boom connecting boss and a position on an inner surface side of said upper plate and on a front side of a position of a connecting pin provided on each of said pair of left and right bucket cylinder brackets; and a rear end of said auxiliary welding member is configured to be extended to a rear side of an upper end portion of said internal partition wall.

10. The arm for a construction machine according to claim 1, wherein a gap generated between each of said pair of first and second bucket cylinder brackets and said auxiliary welding member on said outer surface of said rear part side of said upper plate is configured to be embedded by a welding bead of each of said pair of first and second bucket cylinder brackets and a welding bead of said auxiliary welding member.

11. The arm for a construction machine according to claim 1, wherein said auxiliary welding member is formed having an M-shape in a plan view; and wherein a notched portion, which is notched having a rearward recessed shape, is provided on a front part side of said M-shaped auxiliary welding member.

* * * * *